US007797816B2

(12) United States Patent
Toso et al.

(10) Patent No.: US 7,797,816 B2
(45) Date of Patent: Sep. 21, 2010

(54) METHOD OF DESIGNING AND MANUFACTURING AN ARRAY ANTENNA

(75) Inventors: Giovanni Toso, Haarlem (NL); Piero Angeletti, Lisse (NL)

(73) Assignee: Agence Spatiale Europeenne, Paris (FR)

( * ) Notice: Subject to any disclaimer, the term of this patent is extended or adjusted under 35 U.S.C. 154(b) by 183 days.

(21) Appl. No.: 12/071,519

(22) Filed: Feb. 21, 2008

(65) Prior Publication Data

US 2009/0211079 A1 Aug. 27, 2009

(51) Int. Cl.
*H01Q 13/00* (2006.01)

(52) U.S. Cl. ..... 29/600; 29/601; 343/778

(58) Field of Classification Search ..... 29/600, 29/601; 700/97; 343/778
See application file for complete search history.

(56) References Cited

U.S. PATENT DOCUMENTS

2008/0143636 A1* 6/2008 Couchman et al. ..... 343/915

OTHER PUBLICATIONS

R. J. Mailloux, *Phased Array Antenna Handbook*, 2nd Edition, Artech House, 2005, pp. 92-106.

H. Unz, "Linear arrays with arbitrarily distributed elements," IRE Transactions on Antennas and Propagation, vol. 8, pp. 222-223, Mar. 1960.

R. F. Harrington, "Sidelobe reduction by nonuniform element spacing," IRE Transactions on Antennas and Propagation, vol. 9, pp. 187-192, Mar. 1961.

A. Ishimaru, "Theory of unequally-spaced arrays", IEEE Transactions on Antennas and Propagation, vol. 10, No. 6, pp. 691-702, Nov. 1962.

A. Ishimaru, Y.-S. Chen, "Thinning and broadbanding antenna arrays by unequal spacings", IEEE Transactions on Antennas and Propagation, vol. 13, No. 1, pp. 34-42, Jan. 1965.

M. Skolnik, G. Nemhauser, J. Sherman III, "Dynamic programming applied to unequally spaced arrays", IEEE Transactions on Antennas and Propagation, vol. 12, No. 1, pp. 35-43, Jan. 1964.

J. Sherman III, M. Skolnik, "An upper bound for the sidelobes of an unequally spaced array", IEEE Transactions on Antennas and Propagation, vol. 12, No. 3, pp. 373-374, May 1964.

M. Skolnik, J. Sherman III, F. Ogg Jr. "Statistically designed density-tapered arrays", IEEE Transactions on Antennas and Propagation, vol. 12, No. 4, pp. 408-417, Jul. 1964.

R. L. Haupt, "Thinned arrays using genetic algorithms", IEEE Transactions on Antennas and Propagation, vol. 42, pp. 993-999, Jul. 1994.

T. Isernia, F. J. Ares Pena, O. M. Bucci, M. D'Urso, J. Fondevila Gómez, J. A. Rodriguez, "A Hybrid Approach for the Optimal Synthesis of Pencil Beams Through Array Antennas", IEEE Transactions on Antennas and Propagation, vol. 52, No. 11, pp. 2912-2918, Nov. 2004.

(Continued)

*Primary Examiner*—Derris H Banks
*Assistant Examiner*—Azm Parvez
(74) *Attorney, Agent, or Firm*—Clark & Brody

(57) ABSTRACT

A method of manufacturing an array antenna including a designing step which comprises: determining a one-dimensional reference radiation pattern and an associated reference aperture; computing the cumulative phasorial summation of the field distribution of said reference aperture in a reference direction and representing it as a reference curve in the complex plane; determining a polygonal curve optimally approximating said reference curve, subject to predetermined constraints; and determining, from said polygonal curve, an antenna array pattern, each side of said polygonal curve being associated to a particular antenna element of the array.

30 Claims, 14 Drawing Sheets

OTHER PUBLICATIONS

J. Robinson, Y. Rahmat-Samii, "Particle Swarm Optimization in Electromagnetics", IEEE Transactions on Antennas and Propagation, vol. 52, No. 2, pp. 397-407, Feb. 2004.

M.C. Viganó, G. Toso, S. Selleri, C. Mangenot, P.Angeletti, G. Pelosi, "GA Optimized Thinned Hexagonal Arrays for Satellite Applications", IEEE International Symposium of the Antennas and Propagation Society (AP-S 2007), Honolulu, Hawaii (USA), Jun. 10-15, 2007.

G. Toso, M.C. Viganó, P.Angeletti, "Null-Matching for the design of linear aperiodic arrays", IEEE International Symposium on Antennas and Propagation 2007, Honolulu Hawai USA, Jun. 10-15, 2007.

M. Abramowitz, I. A. Stegun, (Editors), *Handbook of Mathematical Functions with Formulas, Graphs, and Mathematical Tables*, National Institute of Standards and Technology, 5th Printing, 1966.

* cited by examiner

METHOD OF DESIGNING AND MANUFACTURING AN ARRAY ANTENNA

The invention relates to a method of designing and manufacturing an array antenna comprising a designing step and a step of physically manufacturing said array antenna. The inventive contribution of the invention essentially lies in the designing step.

Array antennas offer several advantages over reflector antennas. One of the major is the fact that the array excitation may be closely controlled to generate extremely low sidelobe patterns, or very accurate approximation of a selected radiation pattern. Array antennas are flexible and versatile: by changing the complex feeding excitations (in amplitude and phase) the array pattern may be completely reconfigured. Several methods have been introduced to design linear and planar arrays. A non-exhaustive list of the most famous synthesis techniques includes: the Fourier Transform method, the Schelkunoff method, the Woodward-Lawson synthesis, the Taylor method, the Dolph-Chebyshev synthesis, the Villeneuve synthesis, etc. For a good overview of these methods the text [1] and all the related bibliography may be consulted.

Design techniques known from the prior art usually consider periodic array antennas constituted by equispaced antenna elements, because finite periodic structures have interesting mathematical properties simplifying their analysis and synthesis. According to these techniques, an overall number of array element and a fixed inter-element spacing are determined, and then the most appropriate excitations, in amplitude and/or in phase, in order to guarantee the required performances are identified.

It is also known that a variable spacing between the elements can be used as an additional degree of freedom [2-10]. In this case, the array antenna is aperiodic, i.e. its elements are not arranged on a regular periodic lattice. An aperiodic array may be obtained essentially in two ways: by switching off a certain number of elements in a fully populated periodic array (thinned array) or by placing the elements in a completely aperiodic grid (sparse array). In the general case of a sparse array, the inter-element spacing can be chosen so as to reduce the level of the grating lobes; on the contrary, a thinned array has the same grating lobe level of the fully populated periodic array from which it is obtained.

It should be noted that the terms "sparse array" and "thinned array" are not used consistently in the prior art literature on aperiodic array antennas.

Aperiodic arrays have several interesting characteristics and may offer some potential advantages with respect to equally spaced arrays:

a) First of all, the sidelobe level of equally spaced arrays with uniform amplitude excitation cannot be better than about 13.4 dB (for linear and rectangular arrays), while with aperiodic arrays the peak sidelobe level can be further reduced, provided that the total number of elements is sufficiently large and their positions opportunely selected [5].

b) A second advantageous property of aperiodic arrays is the possibility to realize a "virtual tapering" playing not on the feeding amplitude coefficients but rather on the elements positions, i.e. by using a "density tapering" of the array elements. More precisely, the radiation pattern of a periodic array with non-uniform excitation can be approximately reproduced by an aperiodic array with uniform excitation. In practice, the aperiodic distribution of the elements generates a virtual equivalent tapering. Using a uniform excitation in an array antenna is very advantageous especially in active transmit antennas, because it allows operating the power amplifiers feeding the array at their point of maximum efficiency.

Moreover, using a uniform excitation drastically simplifies the beam-forming network and reduces the corresponding losses.

c) Third, an aperiodic spatial distribution of the antenna elements allows reducing grating lobes in the radiation pattern, even when the spacing between said elements is comparatively high in terms of wavelengths (except for thinned arrays).

d) A fourth interesting property is that by switching off a significant portion of the elements in one assigned aperture, the maximum gain will be proportionally reduced while keeping almost unchanged the angular resolution (so the main beamwidth) of the antenna. This property of course is valid provided that the elements are switched off appropriately and the periphery of the initial aperture remains sufficiently populated. In practice, with a reduced number of elements approximately the same beamwidth, so the same resolution, of one periodic array fully populated may be guaranteed with a drastically lower number of elements.

e) Furthermore, a reduced mutual coupling can be obtained when the interdistance between elements grows and/or is not uniform. The reduced mutual coupling could improve the array robustness with respect to scan blindness.

f) The operational frequency bandwidth of an array may be improved by breaking its periodicity, and grating lobes can be avoided or kept under control while increasing the operational bandwidth.

g) Finally, in fully populated periodic arrays, a thinned excitation may result beneficial in order to reconfigure the pattern properties (beamwidth, sidelobe level and null position). In such a configuration it would be possible to change, with respect to the time, the elements to be switched ON and OFF in order to obtain variable performances.

Several techniques have been presented in the literature to design sparse and thinned array antennas. Aperiodic arrays have been introduced about 50 years ago by Unz [2], who has been pioneering the study of aperiodic arrays using the matrix method. Later on, some important deterministic and numerical theories have been presented to approach the problem. Harrington [3] has implemented a perturbative method. Ishimaru [4, 5] has proposed an analytical method for designing sparse arrays based on the Poisson's sum; this method is effective in controlling the grating lobes amplitude and in increasing the inter-element distance, but it only applies to arrays composed by a high number of elements and has important limitations concerning the level of the first sidelobe adjacent to the main lobe (SLL=21.4 dB independent on the number of elements). Skolnik has been studying the problem of thinned arrays in [6], and the problem of sparse arrays in [7] and [8] adopting a deterministic and statistical approach, respectively. Sparse and thinned arrays have been treated also using the theory of random numbers.

More recently, Genetic Algorithm (GA) and stochastic techniques have been used to approach the problem (references [9-12]) The difficulty of the problem justifies why several authors have been resorting to stochastic, or purely numerical, or probabilistic approaches trying to solve the design of sparse and thinned arrays.

Despite to their advantageous features and all the above-mentioned important characteristics, up to now aperiodic (sparse and thinned) arrays have been seldom used in practice. This is essentially due to the complexity of their analysis and synthesis and, as a consequence, to a reduced knowledge of their radiative properties. The main concern in the design of aperiodic arrays is to find an optimal set of element spacings to meet some array specifications. Since the array factor of the aperiodic array is a nonlinear function of element spacings and there is an infinite number of combinations of element locations, the problem of optimizing the array pattern with respect to the element locations is nonlinear and complex. Thus, it is not easy to design the optimal pattern analytically. The optimization is even more difficult when the array pattern should be scanned off the array normal.

It should be noted that determining the optimal phase of the excitation field of the array elements is also a nonlinear problem, and therefore introduces significant complexity in the design of array antennas. In many cases only an amplitude tapering is used (possibly combined with a linear phase tapering for steering the beam, or with a two-values, 0°/180° phase modulation), despite to the sub-optimal performances that can be achieved.

An object of the present invention is to provide a simple, yet effective, method for designing and manufacturing array antennas by exploiting all the available degrees of freedom of the array (i.e. number of elements, elements' positions, amplitude and phase excitations). In particular, the invention allows using the element positions and/or the excitation phases in alternative or together with the amplitude tapering; this possibility may allow to reduce drastically the costs and the complexity of the array.

The method of the invention is quasi-analytical and has a nice geometrical and physical interpretation.

More particularly, the invention concerns a method of manufacturing an array antenna comprising a step of designing an array pattern of said array antenna and a step of physically manufacturing said array antenna, the method being characterized in that said step of designing said array pattern comprises the following operations:

(a) determining a continuous or discrete one-dimensional reference aperture, associated to a one-dimensional reference radiation pattern;

(b) choosing a reference radiation direction for said reference radiation pattern;

(c) computing a cumulative phasorial summation of a field distribution of said reference aperture in said reference direction and representing said summation as a reference curve in a complex plane;

(d) determining a polygonal curve constituting a polygonal approximation of said reference curve, subject to predetermined constraints;

(e) determining, from said polygonal curve, an array pattern wherein:

- each side of said polygonal curve is associated to a particular antenna element of the array;
- the length of each side represents a normalized amplitude of the excitation field associated with the corresponding antenna element; and
- the angles formed by each pair of adjacent sides correspond to a parameter chosen among:
  - a distance between the elements of the array associated to said sides;
  - a difference between the phases of the excitation fields associated with said elements of the array; and
  - a combination of both.

The manufacturing step can be performed by any method known e.g. from the prior art, directly or after an additional adjustment of the array pattern obtained by applying the method described above, in order to take into account technological constraints (i.e. the finite size of antenna elements).

The array pattern determined at step (e) constitutes an optimal approximation of the reference pattern in a Weighted Least Mean Square sense. This solution, obtainable almost in real time, can also be used as an optimal starting point for numerical refinements based on different constraints and/or optimization criteria.

Indeed, it is not necessary for the array determined from said polygonal curve to constitute the "actual" optimal approximation of the reference radiation pattern: in practice, a "relative optimum" can be sufficient.

It is worth noting that the optimization is performed "locally", i.e. with respect to the reference direction only, but has a "global" effect, i.e. guarantees a good agreement with the reference pattern in a large field of view.

Particular embodiments of the method of the invention constitute the subject-matter of the dependent claims.

More particularly, a method according to an embodiment of the invention allows designing and manufacturing linear aperiodic array (i.e. both sparse and thinned) antennas having a uniform or non-uniform excitation phase. Advantageously, the excitation amplitude can be uniform, or only a few amplitude values ("stepped amplitude") can be used.

A method according to a different embodiment of the invention allows designing and manufacturing a periodic array antenna whose excitation field has uniform amplitude and non-uniform phase.

Additional embodiments of the invention allow designing and manufacturing bi-dimensional array antennas. The bi-dimensional problem is reduced to a set of simpler one-dimensional problems, whose solutions are combined to construct a bi-dimensional array pattern.

An additional object of the invention is a computer software product adapted for carrying out the design step of a method according to any of the preceding claims.

The method of the invention can be applied to the design and manufacturing of different kind of antenna, such as:

- direct radiating planar arrays generating a multibeam coverage for satellite applications with a reduced number of active elements and an equal or stepped amplitude tapering;
- arrays feeding a reflector (single/multiple) or a lens (dielectric, metallic, constrained, zoned, etc.).
- discrete passive or active planar lens.

Antennas designed and manufactured according to the method of the invention can be used in several different applications, such as:

- wireless communications systems;
- navigation application (GNSS satellite antenna, user terminal antenna, reference station antenna, etc.);
- real or synthetic (SAR) radar systems;
- as receive antennas for signal of opportunity reflectometry and interferometry systems (e.g. GNSS-R);
- Very Large Baseline Interferometric (VLBI) applications;
- Ground Penetrating Radar (GPR) applications; and
- acoustic/underwater sensing.

Additional features and advantages of the present invention will become apparent from the subsequent description, taken in conjunction with the accompanying drawings, wherein.

Figure 1A:
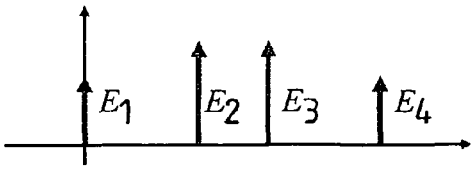
FIGS. 1A to 1D illustrate the concept of phasorial summation.

The invention will be initially described in reference to its application to the design and manufacturing of linear aperiodic array. Then, its generalizations to the case of periodic arrays with phase-only tapering and to that of bi-dimensional arrays will be considered.

The first step of the method of the invention is to define the desired radiative properties of the array to be designed. This is the same as in the prior art. Usually a specified Gain (G), a beamwidth (BW) and a peak sidelobe level (SLL) are indicated. Then, an aperture field distribution ("reference aperture") able to guarantee these radiative characteristics is identified. The reference pattern, which represents the target of the performances of the aperiodic array, may be obtained with a linear aperture having an assigned arbitrary excitation field distribution or with a periodic array having an assigned amplitude/phase tapering. There are several standard techniques to design linear and planar apertures. As an example, well known amplitude distribution laws include: Taylor, Dolph-Chebyshev, Villeneuve, cosine, cosine square, cosine over a pedestal, etc. Thanks to these techniques a continuous aperture distribution and/or a discrete array satisfying the initial radiative requirements may be easily derived in an analytical closed form. According to the prior art, the discrete distribution obtained via one of the several known design procedures may be directly used to realize an antenna. Nevertheless, the direct implementation of a continuous or discrete field distribution with a specific dynamic range of the amplitude and the phase may be difficult and expensive. In facts, especially when the requirements in terms of SLL are very stringent, the feeding distribution of the antenna aperture presents a high variability as a function of the position. The excitation of such an aperture may be extremely complex and expensive. Indeed, one of the strongest motivations to introduce aperiodic arrays with equi-amplitude excited elements consists in the necessity to reduce complexity and cost of an array antenna including its beamforming network and amplification section.

A problem solved by the present invention is to design and manufacture a linear aperiodic array, with equal or stepped amplitude elements, characterized by a pattern that, on average, "best fits" a target reference pattern, and preferably matches the positions of its nulls. The reference pattern represents the target radiative characteristics that should be obtained with the unknown array, and can correspond to the radiation pattern of a continuous aperture or of a periodic array composed by equispaced elements fed with a certain amplitude and/or phase tapering law. In the design of an array which has to guarantee radiative performances as close as possible to the ones of an assigned target pattern, it is particularly delicate and important to match its radiative nulls. This is also justified by the fact that if an array is able to keep the zeros of a target array, almost automatically it is able to reproduce the radiative properties everywhere.

In the far-field approximation, the radiation pattern of a linear continuous aperture is given by the Fourier transform of the aperture excitation field p(x):

$$F(u) = \int_{-\infty}^{\infty} p(\xi) e^{jk_0 u\xi}\, d\xi \tag{1}$$

with $$k_0 = \frac{2\pi}{\lambda},$$

$$u = \sin(\theta)$$

the angle θ, representing the observation direction, is measured with respect to the direction perpendicular to the array aperture.

For a continuous aperture of finite length 2a, equation (1) reduces to:

$$F(u) = \int_{-a}^{a} p(\xi) e^{jk_0 u\xi}\, d\xi \tag{2}$$

For a discrete array, the aperture field can be considered a particular case of the continuous field by mean of the Dirac's Delta functions, $$p(x) = \sum_{k=1}^{N} E_k \delta(x - x_k) \tag{3}$$

and equation (1) reduces to:

$$\begin{aligned} F(u) &= \int_{-\infty}^{\infty} \sum_{k=1}^{N} E_k \delta(\xi - x_k) e^{jk_0 u\xi}\, d\xi \\ &= \sum_{k=1}^{N} E_k e^{jk_0 u x_k} \end{aligned} \tag{4}$$

The aperture field contributions may be represented as complex phasors which depend (see equation (4)) on the positions of the corresponding radiating elements $x_k$, their excitation $E_k$ (amplitude and phase), the wavenumber $k_0$ and the observation direction $u_0$. The length of the phasors is proportional to the amplitude of the corresponding field contribution $|E_k|$, and the orientation depends on the element position $x_k$ and on the excitation phase $\angle E_k$. It is important to note that for each observation direction a different set of phasors is obtained. In particular, the phasors tend to be aligned in a direction of maximum where they are in phase and add in a constructive way while they tend to be oriented in all the possible directions and add in a completely destructive way when focusing on a radiative null direction. For the following discussion it will be convenient to place the origin in the centre of the aperture. Changing the observation direction from the boresight, the phasors start rotating, each with a different velocity depending on the position of the corresponding antenna element. The phasors relevant to the left part of the aperture (with a negative x value) rotate clockwise while those relevant to the right part (positive x value) rotate counterclockwise.

Figure 1B:
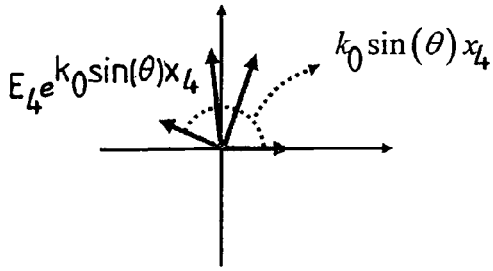
Figure 1C:
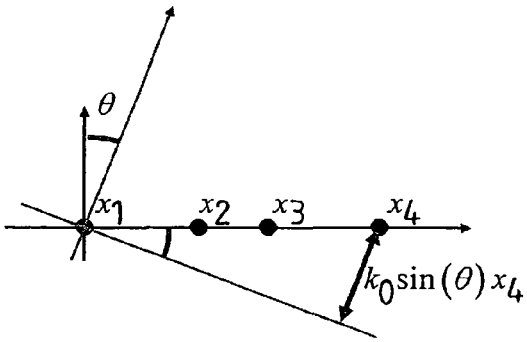

FIG. 1A shows a phasorial representation of a four-element linear array, wherein the excitation fields of the elements, $E_1$, $E_2$, $E_3$ and $E_4$, have a same phase (the corresponding phasors are parallel) and different amplitudes. When observing the array from a direction forming an angle θ with the y axis (FIG. 1B) the phasors rotate (FIG. 1C). Their vectorial sum constitutes the so-called array factor $$AF(\theta) = \sum_{k=1}^{4} E_k e^{jk_0 \sin(\theta) x_k}$$

Figure 1D:
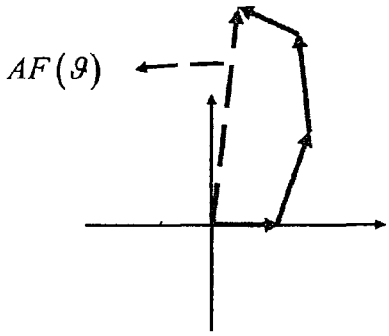

(FIG. 1D). While in FIG. 1C all the phasors are traced from a same origin, in FIG. 1D the origin of the phasor associated to the n-th element coincide with the endpoint of the phasor associated to the (n−1)-th element. Therefore, the cumulative contribution of the different array element can be depicted by a polygonal curve in the complex plane. For a given array, there is a different cumulative phasorial summation, and therefore a different polygonal curve, for each observation direction. It is easy to understand that, for a direction θ corresponding to a null of the radiation pattern of the aperture, where the individual contributions cancel exactly, the cumulative phasorial summation of the array elements is represented by a closed polygonal curve.

For a uniform periodic array (elements characterized by an equal excitation) the cumulative polygonal visualized in the first null direction constitutes a regular polygon, equilateral and equiangular. In the case of an aperiodic array, the polygon will not be equiangular, but it will still be equilateral if the excitation amplitudes are uniform. A non-uniform excitation phase (or "phase tapering") $\phi_k = \angle E_k$ will induce an additional phase term in the vector sum expressing the array factor $$AF(\theta) = \sum_{k=1}^{4} |E_k| e^{j[k_0 \sin(\theta) x_k + \angle E_k]}$$

It should be noted that, while the phase contributions associated to the elements positions depend on the observation direction through the sin(θ) term, the phase tapering adds a contribution which depends only on the element position but not on the observation angle. As a consequence, for a periodic array whose excitation field has a uniform amplitude and a non-uniform phase, the cumulative polygonal visualized in the first null direction will constitute an equilateral but not equiangular closed polygonal curve.

In summary, it can be said that the cumulative phasorial summation of the elements of an array antenna in a given observation direction can be represented by a polygonal curve, wherein each side of said polygonal curve is associated to a particular antenna element. The length of each side is associated to the amplitude of the excitation field of the corresponding element, while the angles formed by each pair of adjacent sides depend on the inter-element distance and/or the phase tapering of said excitation field. The polygonal curve associated to a direction for which the radiation pattern of the array antenna exhibits a null will be a closed curve.

Figure 2A:
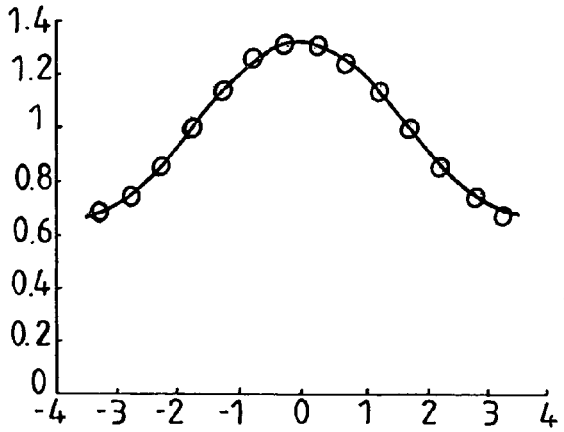
FIGS. 2A to 2D show how an array antenna can approximate the radiation pattern of a continuous radiating aperture.

For a continuous aperture, the polygonal degenerates in a continuous curve made of infinitesimal incremental contributions. FIG. 2A shows the amplitude tapering p(x) of the excitation field of a continuous aperture (represented with a continuous line) and the one of a corresponding periodic array (represented with circles). FIGS. 2B and 2C represent the curves associated to the cumulative sum of the continuous aperture and of the array, respectively, for a direction corresponding to the first null of the radiation pattern. It can be seen that the curve of FIG. 2B is continuous, while that of FIG. 2C is an equiangular (because there is no phase tapering and the array is periodic) but not equilateral (because there is an amplitude tapering) polygonal. Strictly speaking, the closed polygonal curve of FIG. 2C is equiangular except in the region close to the origin ([0,0] point), where it is concave.

Figure 2D:
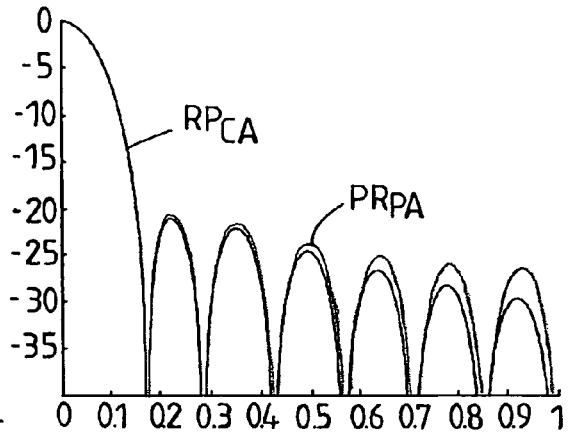
Figure 2B:
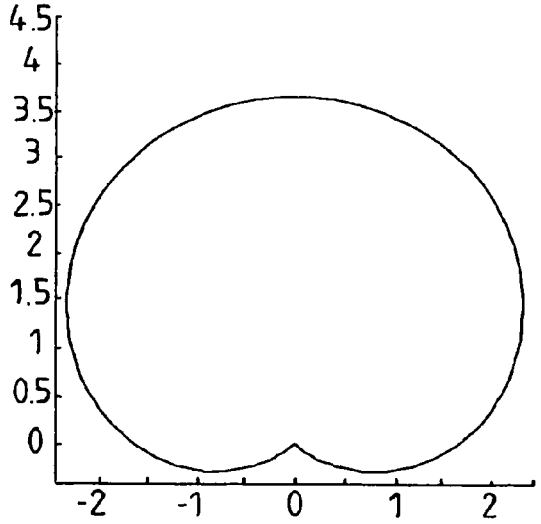
Figure 2C:
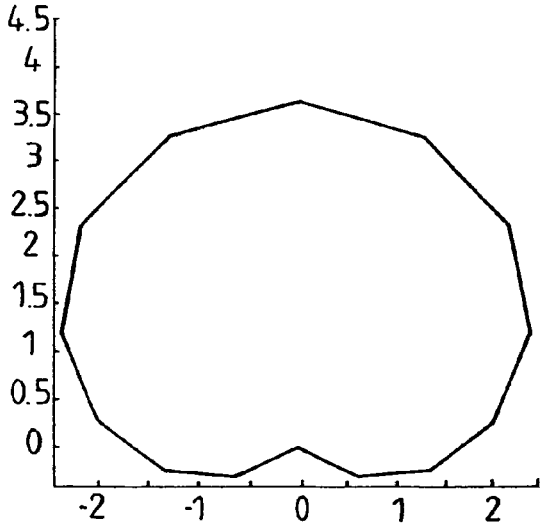

The semilogarithmic plot of FIG. 2D allows comparing the radiation patterns of the continuous aperture ($RP_{CA}$ line) and of the periodic array ($RP_{PA}$). It can be seen that the principal lobes of both antennas are almost indistinguishable, but that the periodic array exhibits stronger secondary lobes.

In order to express the previous properties in analytical form, the cumulative phasorial summation of the aperture field distribution can be introduced, $$T(x, u) = \int_{-\infty}^{x} p(\xi) e^{jk_0 u\xi} d\xi \tag{5}$$

which can be particularized in:

$$T(x, u) = \int_{-a}^{x} p(\xi) e^{jk_0 u\xi} d\xi \text{ (Continuous Aperture)} \tag{6}$$

$$T(x, u) = \sum_{k=1}^{N} E_k e^{jk_0 u x_k} U(x - x_k) \text{ (Discrete Array)} \tag{7}$$

where U(x) is the step function, $$U(x) = \begin{cases} 0 & x < 0 \\ 1 & x \geq 0 \end{cases} \tag{8}$$

The ending point of the phasorial cumulative sum (for both the discrete array and continuous aperture) represents the complex radiation pattern as evaluated in the corresponding direction of observation.

$$\lim_{x \to \infty} T(x, u) = F(u) \tag{9}$$

Being both the continuous apertures as well as the discrete arrays considered in the following of finite extent, equation (9) can be replaced by:

$$T(x,a) = F(u) \text{ (Continuous Aperture)} \tag{10}$$

$$T(x_N, u) = F(u) \text{ (Discrete Array)} \tag{11}$$

The array design problem can be expressed as follows: for an assigned reference pattern $\tilde{F}(u)$, corresponding to a continuous or discrete reference aperture $\tilde{p}(x)$ and characterized by a cumulative phasorial sum $\tilde{T}(x,u)$, the objective is synthesizing a periodic or aperiodic array whose radiation pattern best fits the reference pattern, subject to predetermined constraints and using different degrees of freedom (i.e. elements positions, amplitude or phase tapering). There are several ways to define a best fitting optimization criterion. One particularly effective consists in a weighted mean square error (W-MSE) minimization of the difference between the reference pattern and the unknown one.

The design method of the invention is based on the following result, which can be demonstrated by applying the Parseval-Plancherel theorem:

$$\int_{-\infty}^{\infty} \frac{1}{(u-u_0)^2} |F_1(u) - F_2(u)|^2 \, du = c \int_{-\infty}^{\infty} |T_1(x, u_0) - T_2(x, u_0)|^2 \, dx \quad (12)$$

The left term in Equation (12) represents a weighted mean square error of the patterns, with an inverse quadratic weighting function centered in the observation point characterized by $u_0$. It is important to note that, while in the left term the patterns are compared in the entire field of view (global criterion), in the second term the cumulative phasorial summations are evaluated only in one specific observation point $u_0$.

Equation (12) demonstrates that the minimization of the pattern difference can be reduced to an un-weighted mean square error minimization of the cumulative phasorial summations evaluated in $u_0$.

Otherwise stated: the array whose radiation pattern best approximates the reference radiation pattern (according to a weighted mean square error criterion) is that whose cumulative phasorial sum for the reference direction $u_0$ best approximates that of said radiation pattern for the same reference direction. As the cumulative phasorial sum of a continuous or discrete aperture can be represented by a continuous or polygonal curve, the array synthesis problem reduces to the geometrical problem of finding the polygonal curve that best approximates, subject to predetermined constraints, a given continuous or polygonal curve. This problem can be solved numerically or by purely graphical means: therefore the array synthesis is greatly simplified.

The method discussed above is completely general, and can be applied to any kind of linear arrays. However, it is particularly interesting to apply it to arrays which are difficult to design by using prior art methods, e.g. aperiodic (sparse of thinned) arrays and periodic arrays with phase-only taper.

Of course, the choice of the reference direction $u_0$ is critical in order to ensure that the weighted mean square error criterion centered on it is meaningful. As previously discussed, when designing a periodic or aperiodic array, it is usually required that the nulls of its radiation pattern match those of the reference pattern. In particular the first null plays a key role because it substantially defines the beamwidth. In [13] a null matching technique has been successfully used for designing an aperiodic array. However, while the technique presented in [13] is based on a numerical min-max procedure, the technique presented here is a graphical quasi analytical procedure.

For this reason, the most convenient choice of the reference direction $u_0$ will usually be that of the first null of the reference pattern:

$$\tilde{F}(u_0)=0 \quad (13)$$

The cumulative curve $\tilde{T}(x,u_0)$ corresponding to such a reference direction is a closed curve, being, $$\tilde{T}(-\infty,u_0)=0 \text{ according to Eq. (5)}, \quad (14)$$

and $$\tilde{T}(\infty,u_0)=\tilde{F}(u_0)=0 \quad (15)$$

according to Eq. (13).

As a representative example, the design of a sparse array with uniform excitation will be considered, by taking a continuous Taylor distribution as the reference distribution. The Taylor distribution is the amplitude-only continuous distribution represented on FIG. 2A; therefore the reference radiation pattern to be approximated by the aperiodic array is the pattern of FIG. 2D ($RP_{CA}$ line). It is important to note that this reference pattern correspond to an aperture characterized by non-uniform excitation amplitude, while the aperiodic array to be designed is uniformly excited.

As demonstrated in equation (12), the array synthesis problem is equivalent to the identification of a cumulative phasorial polygonal optimally fitting the reference cumulative curve. The unknown polygonal is characterized by equilength edges in agreement to the assumed equiamplitude feeding distribution. Besides, because the tracing of the polygonal is done in a null direction, the polygonal must be closed.

So, in practice, the design is equivalent to find a best fitting closed polygonal which should be equilateral but not equiangular (otherwise it would correspond to a periodic array). Once the best fitting polygonal is obtained, the positions of the array elements can be easily derived inverting equation (7). In practice, the rotation angle of a generic side of the polygonal with respect to the previous one is directly related to the distance of the two radiating elements associated to the sides.

In the following, in order to simplify the formulation, real and symmetric reference apertures are considered, N being the (even) number of elements if the reference aperture is constituted by a periodic array. At the same way, symmetric aperiodic arrays with an even number of elements M are assumed for the synthesis. This hypothesis does not represent a restriction for the proposed method, but permits to simplify the explanation and it is justified because most of the reference aperture distributions are symmetric.

The array factor of a symmetric array is always real because it is obtained by summing phasors that are, two by two, symmetric with respect to the real axis (by summing two complex conjugate numbers one obtains twice the real part of each one).

As the aperiodic array and the reference aperture (continuous or discrete) are assumed to be symmetric, it is sufficient to consider half of the closed reference polygonal as a target to determine the position of half of the elements of the aperiodic array, the positions of the others being derived by symmetry.

Figure 3:
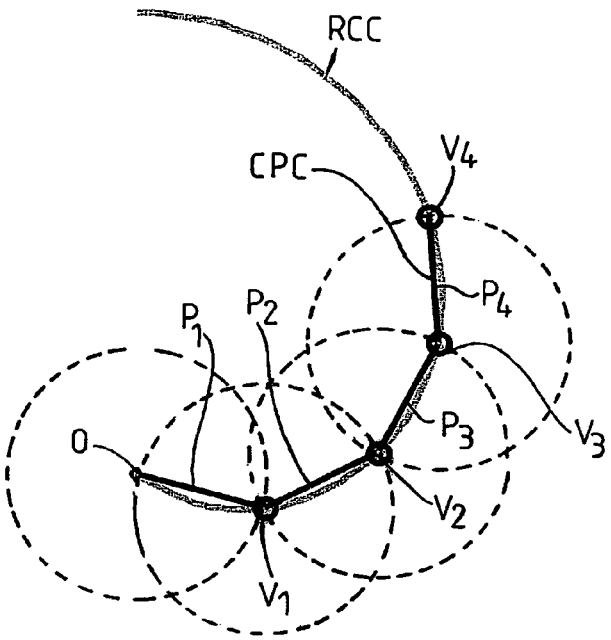
FIG. 3 illustrates a method of the invention, applied to the design of a linear sparse array with uniform excitation.

The closed reference cumulative curve may be rescaled to have a length equal to M, i.e. the number of elements constituting the unknown aperiodic array. Then, as represented on FIG. 3, starting from the origin O of the reference cumulative curve RCC, M/2 equal length phasor chords $P_1 \ldots P_{M/2}$ are sequentially traced internally to said reference cumulative curve to have all the M/2 vertices $V_1 \ldots V_{M/2}$ lying on the curve itself.

However, because half of the reference cumulative curve has a curvilinear length equal to M/2 and the M/2 unitary chords are inscribed within the curve, the last vertex of the phasorial summation will not coincide with the middle point of the reference cumulative curve but will slightly trespass this point and will be located in the second half of the reference cumulative curve. Iteratively the chords length can be rescaled until the last vertex coincides with the middle point of the reference cumulative curve. Because only a few iterations are needed to obtain the convergence, the synthesis is done almost in real time. In this way, we have obtained graphically M/2 equilength phasors perfectly inscribed in the first half of the reference cumulative curve. By symmetry the second half of the polygonal may be immediately derived.

In case of non-symmetric reference apertures the procedure must be simply extended to the sequential tracing of all the M equal length phasors to best-fit the asymmetric reference cumulative curve RCC.

Once the equilateral polygon matching the closed curve has been derived, it is straightforward evaluating the positions of the corresponding aperiodic elements.

The same graphical methodology could be also applied to one of the other nulls of the reference pattern. However, it is important to note that the closed reference cumulative curve, when evaluated in a null different from the first, will present a number of internal loops depending on the index of the null and on the tapering law of the reference aperture. For this reason it is much simpler, and provides more accurate results, to apply the described technique in the first radiation null.

Notwithstanding the null matching is imposed in a single radiation null, the pattern of the synthesized sparse array is able to match extremely well also the following nulls of the reference pattern and to provide excellent fitting performances in the entire field of view.

The fitting accuracy in terms of weighted mean square error strictly depends on the number of elements of the aperiodic array.

The reference cumulative curve, being associated to an aperture with amplitude tapering, will exhibit a continuous variation of its curvature. For this reason, a better approximation could be obtained tracing chords of different length having, in particular, a shorter length in proximity of sharp bends and a longer one when the curvature radius is larger. This is equivalent to design an aperiodic array with the additional degree of freedom represented by an amplitude tapering. Despite to the advantage associated to the amplitude tapering, usually aperiodic arrays are fed with equal amplitude in order to keep their cost and complexity limited, to operate the feeding power amplifiers at their optimum point (in term of power efficiency) and because a virtual equivalent tapering is anyway offered by the aperiodic placement of the elements. As a compromise, a limited numbers of amplitude levels may guarantee better performances with a limited extra cost and complexity. Unlike in the case of prior art array antennas with amplitude tapering, very good results can be achieved by using a number of amplitude levels which is small (e.g. by a factor of 10 or more) compared to the number of antenna elements. Advantageously, the allowed amplitude levels can be in a commensurable relationship with each other: that way, these levels can be obtained by splitting and/or combining the outputs of power amplifiers operated at their optimum point, with no significant loss of efficiency.

Figure 10A:
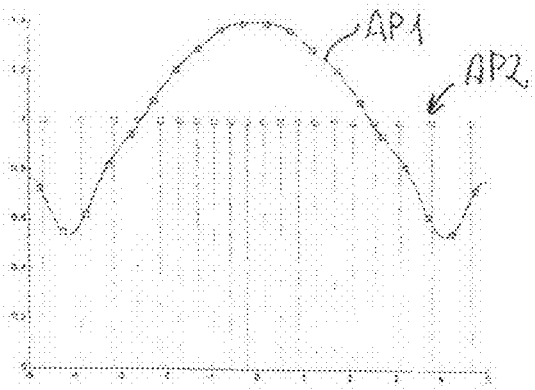
FIGS. 10A to 14B illustrate the technical results of the invention.
Figure 10B:
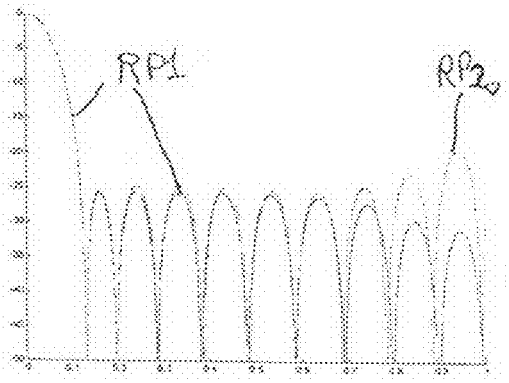
Figure 11A:
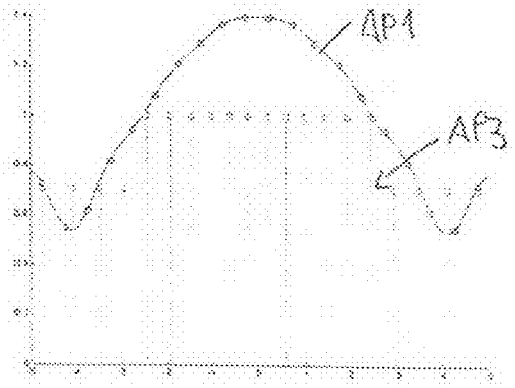
Figure 11B:
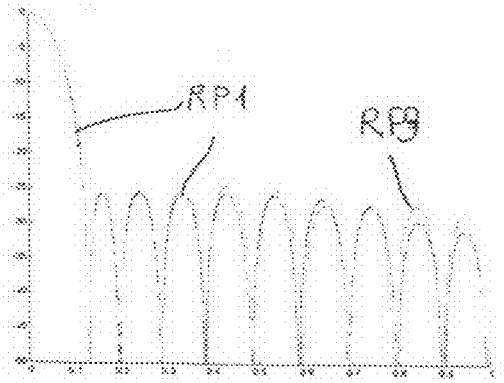

FIG. 10A compares the array pattern of a conventional 20-element periodic array ensuring a sidelobe level of 25 dB (AP1) with that of an aperiodic array having the same number of elements, excited with uniform amplitude and phase (AP2). FIG. 10B compare the corresponding radiation patterns PR1, PR2 respectively. It can be seen that the aperiodic array designed according to the method of the invention reproduces very well the main lobe and the first secondary lobe. However, a significant increase in the level of high-order sidelobes can be observed. A significant improvement in the quality of the radiation pattern can be obtained by taking two amplitude levels in the aperiodic array pattern (AP3 on FIG. 11A). On FIG. 11B, curve RP3 represents the radiation pattern of a two-amplitude, two-phase level aperiodic array; it can be seen that, in this case, the level of high-order sidelobes is almost as low as in the periodic array with amplitude tapering. The method of the invention has been described for the case of a sparse array. One of the advantages of the new procedure consists in the fact that it can be easily applied also in the design of thinned arrays, i.e. aperiodic arrays obtained by switching off some of the elements of a periodic fully populated array.

Thinned arrays exhibit a reduced number of degrees of freedom with respect to sparse arrays because the spacings between the elements are forced to be integer multiples of an assigned minimum distance. For this reason, every element may be represented by a discrete set of rotating phasors $P'_1 \ldots P'_{M/2}$ with a fixed angular separation (see FIG. 4). As a consequence, the vertices $V'_1 \ldots V'_{M/2}$ of the locally allowed chords can not be imposed lying on the reference cumulative curve RCC.

Figure 4:
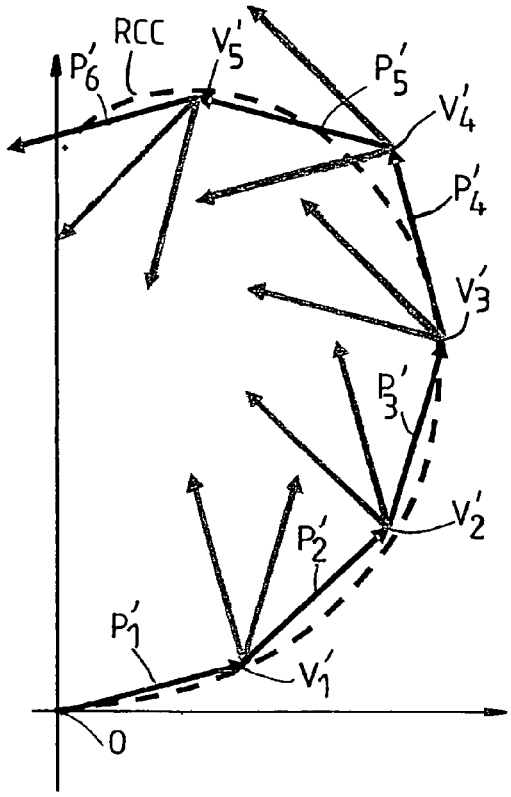
FIG. 4 illustrates a method of the invention, applied to the design of a linear thinned array with uniform excitation.

FIG. 4 shows clearly how different spacings affect the local shape of the polygonal and produce different fitting results. The best solution still consists in tracing a polygonal which overall best fits the reference curve. Usually the central elements of thinned arrays are all excited while close to the periphery some elements are switched off. Thanks to the graphical design procedure of the invention it is straightforward to identify an extremely limited set of good solutions best fitting the reference polygonal and then to extract the best solution out of them.

As mentioned above, the design method of the invention is very general, and not limited to the case of aperiodic (sparse or thinned) arrays. Its application to the synthesis of a periodic array whose excitation field has uniform amplitude and non-uniform phase ("phase-only taper") will now be described. This was a difficult problem in the prior art, because the phase is related to the radiated field in a non linear way as the elements positions. However, while the elements positions are multiplied by the factor $\sin(\theta)$ which causes a different contribution as a function of the observation angle, the phase tapering adds a radiative contribution which depends only on the elements but not on the observation angle.

As the array to be designed is periodic, it is convenient to take as the reference aperture a periodic array with amplitude-only tapering, having the same number of elements as the array to be designed. The (discrete) reference cumulative curve DRCC of said discrete reference aperture is an equiangular but non-equilateral polygonal curve. According to the theory discussed above, it is clear that the cumulative curve of the array to be designed will be an equilateral but non-equiangular polygonal approximating the DRCC.

Figure 5A:
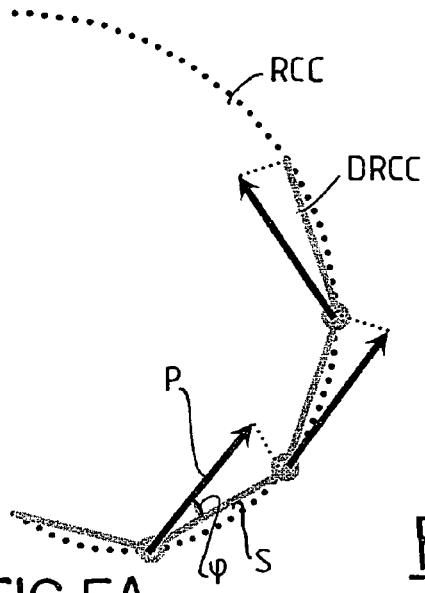
FIGS. 5A and 5B illustrate a method of the invention, applied to the design of a periodic array excited with phase-only tapering.
Figure 5B:
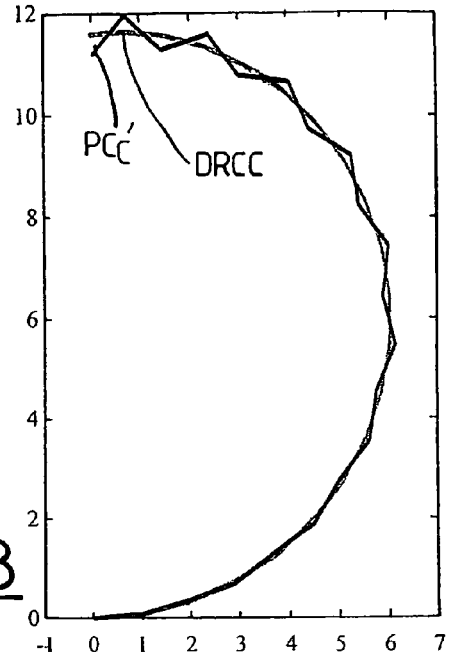

As an example, in FIGS. 5A and 5B, DRCC represents the discrete reference cumulative curve, RCC the continuous reference curve of the corresponding continuous reference aperture and PCC' the cumulative curve of the array to be designed. The angle between contiguous sides of the DRCC curve is fixed (periodic array). The side lengths are normalized in such a way that the maximum length is equal to 1; so in general, the sides of DRCC have a length minor or equal to 1. A periodic array with equal amplitude elements characterized only by a phase tapering which best fits the reference one is now easily obtainable. In facts, simply using Pythagoras' theorem, the local amplitude may be considered as the cathetus of a rectangular triangle, while the unitary amplitude element is the hypotenuse of the same triangle. This elementary property is represented on FIG. 5A, where S is a side of the DRCC curve and P a unit-length phasor oriented so as to constitute the hypotenuse of a rectangular triangle of which S is a cathetus. The angle $\phi$ between S and P represent the phase of the excitation field of the array element represented by the phasor P.

Without phase tapering, phasor P would be aligned with the shorter segment S. By applying the phase tapering, the phasors are rotated in such a way that their projections on the sides of the DRCC coincide with the sides themselves. In this way the phase-only tapered array represents the best fitting of the amplitude-only tapered array.

Of course, for a selected phase angle even its opposite value satisfies the same property. In order to best fit the reference curve DRCC, it is convenient to select alternatively a positive and a negative sign for the phase values, in such a way that the phasors are traced one time internally, the next time externally to DRCC. Otherwise stated, the angles between adjacent sides alternatively take positive and negative modulo-180° values. This choice guarantees the same level of accuracy with the reference pattern also in the neighboring of the first null in the opposite direction with respect to the main beam. So, in practice, the proposed only-phase tapering provides a good matching of the reference pattern in an angular region close to the main beam symmetrically located with respect to it.

As a final result, the phase-only tapering function obtained graphically has the following simple analytical expression:

$$\phi_k=(-1)^k \cos^{-1}(E_k)$$

wherein $\phi_k$ is the phase of the excitation field of the k-th antenna element, while $E_k$ is the normalized length of the k-th side of the reference DRCC curve. In practice, as a result of the new array tracing technique, the design of a periodic array with a phase-only tapering can be done analitically: the required phase values are simply obtained as a function of the amplitude tapering coefficients of the reference aperture.

It will be understood that the method of the invention can also be applied to the synthesis of array antennas combining phase tapering with amplitude tapering and/or "density tapering", i.e. an aperiodic array pattern.

Figure 12A:
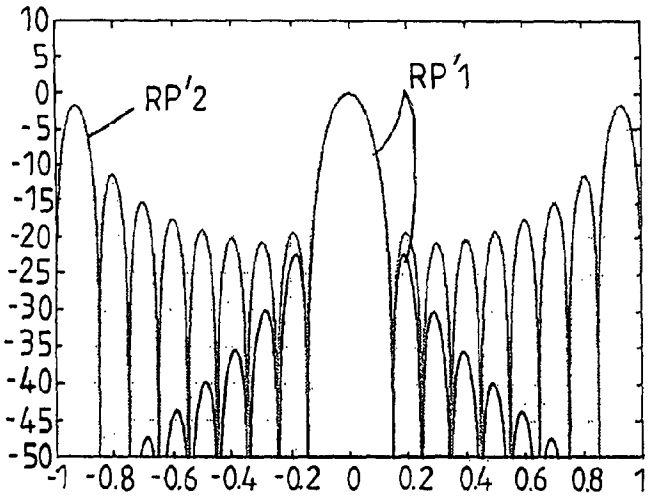

On FIG. 12A, curve RP'1 represents the radiation pattern of a 20-element periodic array having a cosine-type amplitude-only tapering.

Figure 12C:
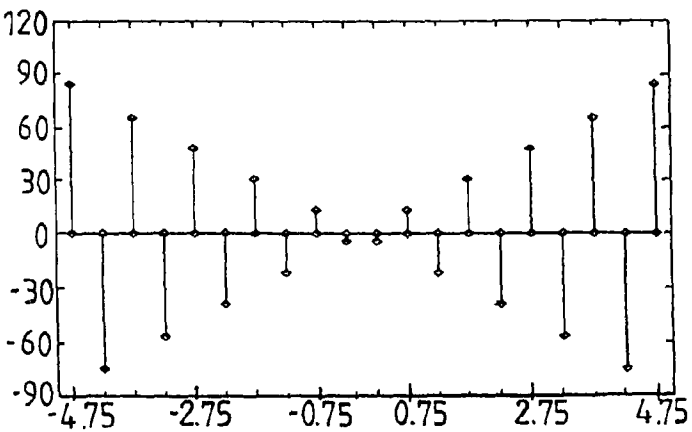
Figure 12B:
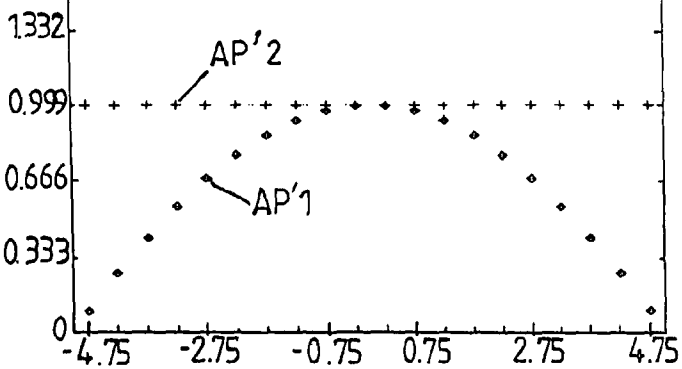

Curve RP'2 represents the radiation pattern of the corresponding periodic array with phase-only tapering. It can be seen that the sidelobe level is quite high, especially for high-order lobes, because of the limited number of available degrees of freedom (i.e. phase only). On FIG. 12B, dots (AP'1) represent the amplitude tapering of the reference array, and crosses (AP'2) show the uniform amplitude of the array according to the phase-only embodiment of the invention. The phase tapering of this array is represented on FIG. 12C.

Figure 13A:
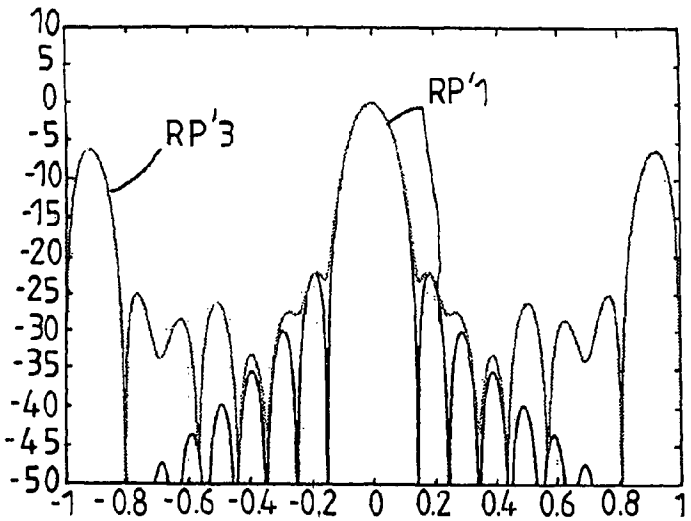
Figure 13C:
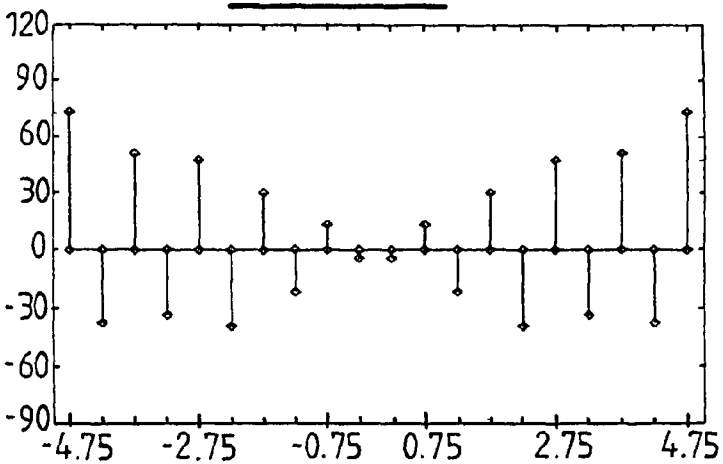
Figure 13B:
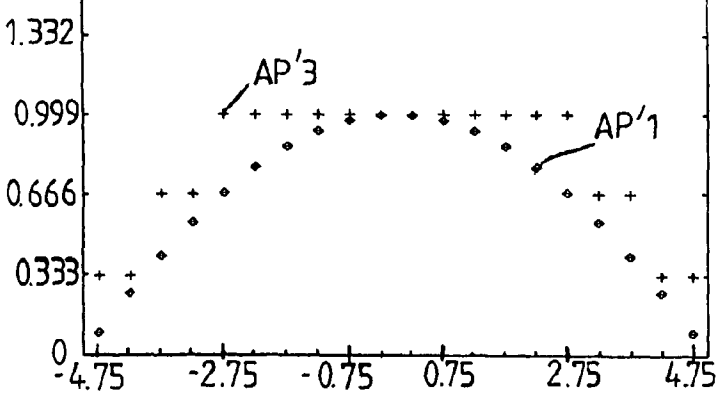

Significantly better results can be achieved by combining phase- and stepped amplitude-tapering. Curve RP'3 on FIG. 13A shows the radiation pattern of a 20-element periodic array with phase tapering and three amplitude values. Amplitude and phase distribution of this array are represented on FIGS. 13B (crosses AP'3) and 13C respectively.

A case in which it is strongly advisable to use a non-uniform excitation phase together with "density tapering" (i.e. a non-periodic array) is the design of an aperiodic linear array for generating a "shaped beam".

A simple, yet very important, example of shaped beam is the one whose radiation pattern is described by a rectangular function. In order to generate this beam pattern a sinc(x)=sin(x)/x distribution on the aperture is needed (the sinc function representing the Fourier transform of the rectangular function). Let us consider for example a reference linear aperture with a width of 20 wavelengths λ, where an amplitude tapering proportional to sin(x)/x is applied. This sinc(x) distribution is represented on FIG. 6A: it can be seen that the excitation is expressed in terms of a real function with positive and negative values, while in the previous cases the aperture was simply expressed in terms of a positive real function. The sinc function in this example is characterized by one main lobe and four sidelobes on each side.

Four different methods according to the principle of the invention can be applied to synthesize an aperiodic array emitting a rectangular beam.

The first possibility is to synthesize an aperiodic array with uniform (in phase and amplitude) excitation, as explained above with reference to FIG. 3. This method is simple, and arrays with uniform excitation are optimal in terms of power efficiency and structural simplicity.

However, this method does not lead to satisfactory results. The reason will be understood by examining FIG. 6B, representing the reference cumulative curve for the reference aperture of FIG. 6A (RCC) and the cumulative polygonal curve (CPC) corresponding to the optimal aperiodic array consisting of 40 elements with uniform excitation.

Figure 6A:
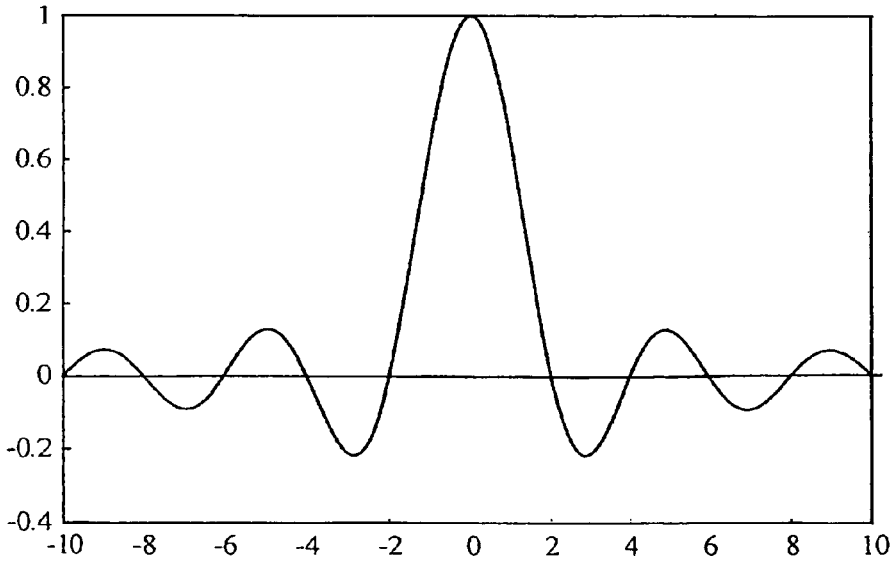
FIGS. 6A to 6C illustrate a method of the invention, applied to the design of an aperiodic array whose radiation pattern defines a "shaped beam"
Figure 6B:
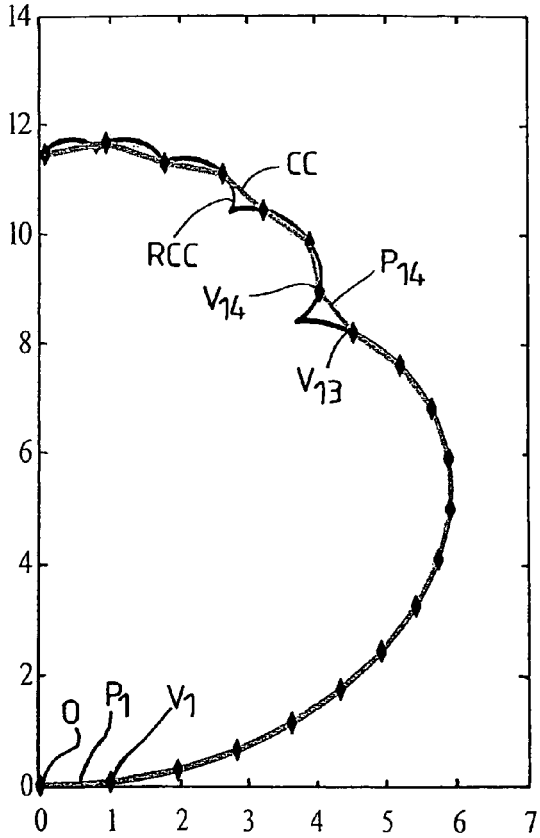

FIG. 6B shows that the four changes of sign of the reference aperture distribution generate four cusps in the RCC curve. It can be seen on the figure that the fourteenth phasor P14, joining vertex V13 and V14, and corresponding to the first cusp of RCC, is rotated in clockwise direction with respect to the thirteenth phasor P13. Since, for increasing x, the phasors always rotate counterclockwise, a clockwise rotation of 60° actually corresponds to a counterclockwise rotation of 360°−60°=300°. In the selected example, where the first radiative null is characterized by sin(θ)≈0.27 a rotation of 300° implies an inter-element separation of more than three wavelengths. The same effect appears when going from the 14th to the 15th element, from the 16th to the 17th and from the 18th to the 19th. As a result, the aperiodic array synthesized according to this method has a width of 32 wavelengths, to be compared with the 20 wavelengths of the reference aperture. Besides this significant increase (+60%) in the aperture dimension, the large spacings between the last elements are responsible of annoying grating lobe contributions.

Figure 14A:
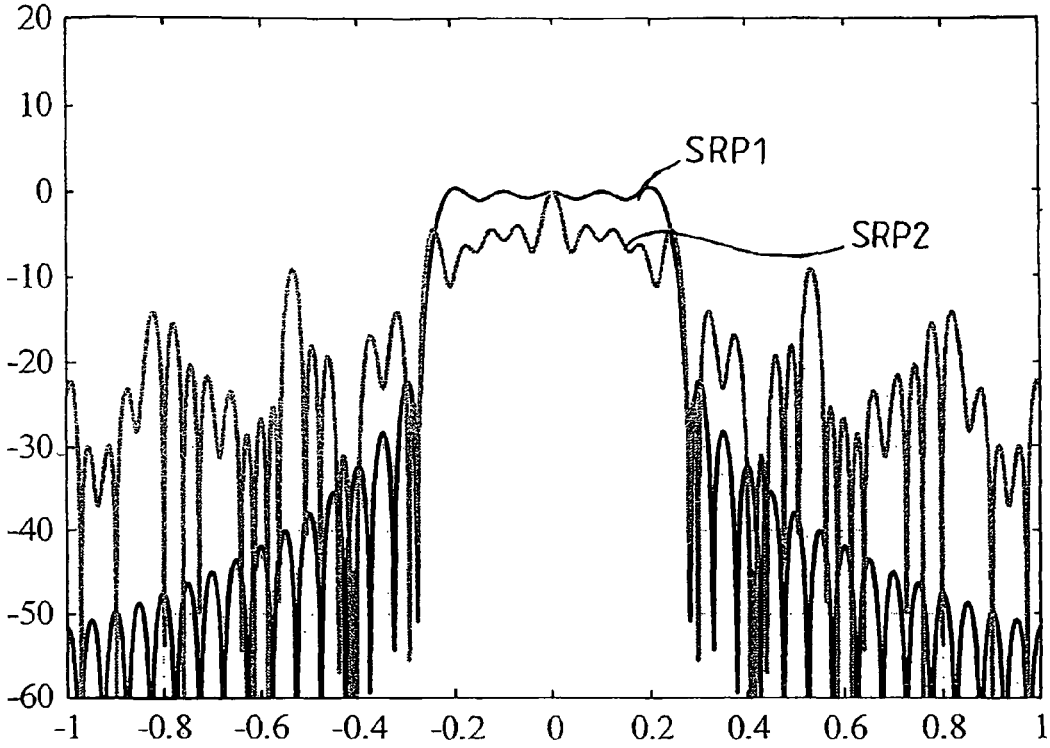

FIG. 14A compares the reference radiation pattern corresponding to the reference aperture of FIG. 6A (curve SRP1) with that of an aperiodic array with uniform phase and amplitude excitation (SRP2). It can clearly be seen that the matching of the radiation pattern is rather poor.

A second possibility is to synthesize an aperiodic array, in which the excitation distribution is characterized by a uniform amplitude and two possible phase values (i.e. 0° and 180°).

Figure 6C:
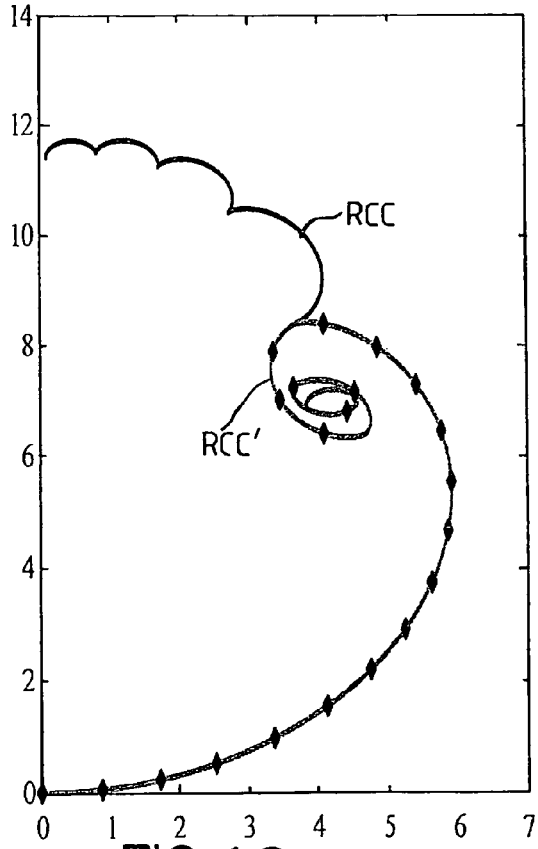

According to this alternative method, the cusps in the reference cumulative function are suppressed by taking a reference aperture whose amplitude distribution is given by the absolute value of the "original" sinc distribution. The cumulative phasorial summation corresponding to this "modified" reference aperture is represented by curve RCC' on FIG. 6C. Curve RCC' coincides with the original cumulative curve RCC up to the first cusp, but then it keeps turning smoothly in a counterclockwise direction. Correspondingly, the phasors of the polygonal cumulative curve CPC' fitting the reference curve RCC' all exhibit counterclockwise rotations.

The element spacings of the aperiodic array to be synthesized are obtained from this polygonal cumulative curve CPC'. However, in order to obtain a radiation pattern approximating the reference one, a phase shift of 180° has to be applied to the excitation field of the array elements corresponding to the negative portion of the original (sinc(x)) reference aperture.

Figure 14B:
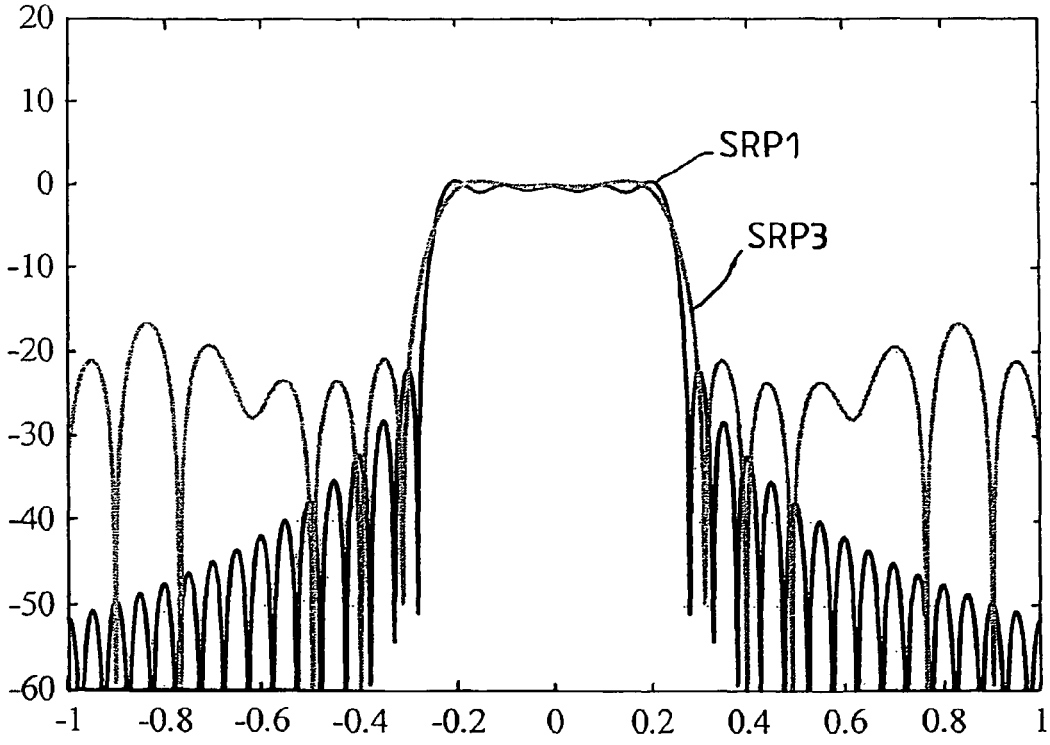

FIG. 14B shows that the use of two phase values and a uniform amplitude in an aperiodic array already leads to a very satisfactory matching of the radiation pattern (SRP3) with the reference one (SRP1).

The third and fourth methods are simply refinements of the method described above. They include the use of two amplitude values (third possibility) or of several stepped amplitude levels, e.g. one for every lobe in the near field sinc distribution (fourth possibility).

While, in general, the first method is not satisfactory for the design of shaped beams, the choice between the second, the third and the fourth one depend on a tradeoff between performances and complexity.

The graphical design method described above only applies to one-dimensional (or linear) arrays. However, the present invention also allows synthesizing bi-dimensional array antennas. The idea behind this extension of the scope of the invention is that a bi-dimensional synthesis problem can be often decomposed in a set of one-dimensional sub-problems. These sub-problems can be solved, i.e. the corresponding linear array patterns can be determined, as discussed above. Then, the array pattern of the required bi-dimensional antenna can be constructed from said set of linear array patterns.

More precisely, three methods for synthesizing aperiodic bi-dimensional arrays will be described in detail. The first method leads to a bi-dimensional array whose elements are disposed according to a non-uniform rectangular—or, more generally, parallelogram—grid. The second method is more complex, but allows obtaining more satisfactory results; it leads to an array whose elements are aligned along a principal axis and independently distributed along a secondary axis, which is non-parallel and preferably perpendicular to the principal axis. The third method applies to reference radiation patterns exhibiting a circular or elliptical symmetry and leads to an array whose elements are disposed in concentric circular or elliptical rings.

These methods are only exemplary, and not limitative.

The first method can be applied whenever the reference pattern and the reference aperture can be written as the product of two separable functions of two spatial coordinates x,y corresponding to two (typically, but not necessarily, orthogonal) preferred axes (i.e. as a function of the form: $p(x,y)=p_x(x)p_y(y)$, or it can be approximated by such functions.

If the reference pattern does not satisfy exactly this separability condition, the preferred axes x,y should correspond to the directions along which it is most important to control the actual radiation pattern. The planar reference aperture distribution p(x,y) is then projected onto the selected axes x,y.

$$p_x(x)=\int_{-\infty}^{+\infty}p(x,y)dy$$

$$p_y(y)=\int_{-\infty}^{+\infty}p(x,y)dx \tag{16}$$

The evaluation of the projections can be performed either analytically, if the reference aperture distribution is available in analytic form and the projection integral has a closed form, or numerically.

These projections establish two linear reference distributions for the application of the one-dimensional design method described above.

Figure 7A:
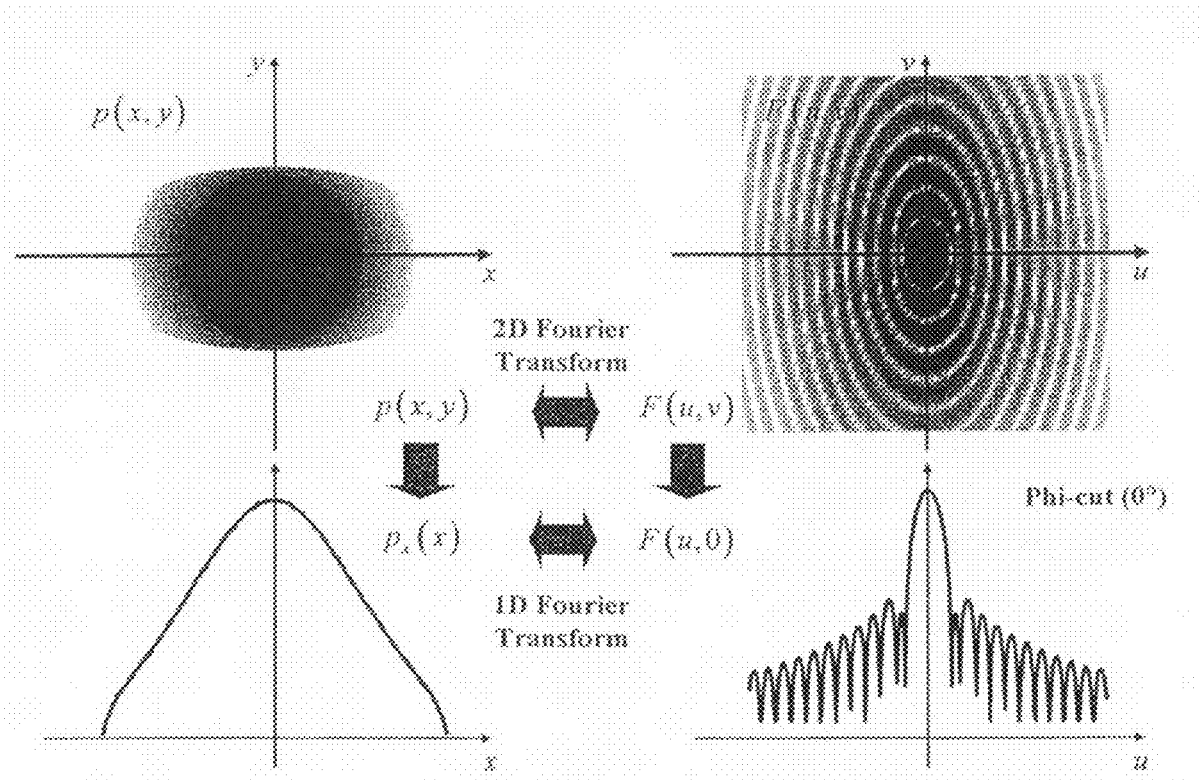
FIGS. 7A to 7C illustrate a method of the invention, applied to the design of a bi-dimensional array antenna.

The reason stands on the Fourier transform projection-slice theorem in two dimensions which states that the Fourier transform of the projection of a two-dimensional function onto a line is equal to a slice through the origin of the two-dimensional Fourier transform of that function which is parallel to the projection line (i.e. a phi-cut; see FIG. 7A).

A discrete element grid G is superimposed to the reference aperture support domain (i.e. the spatial domain where the reference aperture function is different from zero). The number of elements of the initial discrete grid corresponds to the number of active elements of the desired planar aperiodic array (N). The element grid can be a periodic lattice, an aperiodic grid or any combination of the two.

$$G=\{r_k\equiv x_k\hat{x}+y_k\hat{y}:k=1,\ldots,N\} \tag{17}$$

Relative amplitude values ($E_k$) can be optionally assigned to each element of the initial grid.

As demonstrated for the linear case, a limited numbers of amplitude levels may be introduced to guarantee better performances with a limited extra cost and complexity. The optional assignment of the relative amplitude values ($E_k$) can be performed, for example, quantizing with a number of pre-assigned levels the planar reference aperture distribution p(x, y) sampled in correspondence of the initial grid positions, $p(x_k, y_k)$. The amplitude values $E_k$ will constitute the excitations of the radiating elements whose positions will be determined according to the method described here below.

The set of the elements positions G intrinsically generates two sets of coordinates with respect to x and y:

$$G_X=\{x_k:k=1,\ldots,N\}$$

$$G_y=\{y_k:k=1,\ldots,N\} \tag{18}$$

These two coordinate sets can be processed to identify the ordered unique elements that constitute each individual set.

$$\overline{X}=\text{Unique}(X) \tag{19}$$

The "Unique" operation of equation (19) returns the same values as in X but with no repetitions.

Two subsets $\overline{X}$ and $\overline{Y}$ of $G_x$ and $G_y$, respectively, are created which correspond to the distinct projections of the initial grid elements expressed in the coordinate defined by the preferred axes on same preferred axes.

$$\overline{X}=\text{Unique}(G_x)=\{\overline{x}_p:p=1,\ldots P\}$$

$$\overline{Y}=\text{Unique}(G_y)=\{\overline{y}_q:q=1,\ldots Q\} \tag{20}$$

The two ordered subsets $\overline{X}$ and $\overline{Y}$ are the base for synthesizing two equivalent linear arrays whose radiation patterns approximate the two selected phi-cuts reference patterns. The arrays along x and y will be composed of P and Q equivalent elements, respectively. Each element of the equivalent array will have an assigned amplitude taking into account:

- that each element of the unique coordinate set $\overline{X}$ and $\overline{Y}$ can correspond to a multiplicity of elements of the original set of elements positions G (i.e. all the elements with same coordinate value are collapsed in a single element of the equivalent array);
- that different elements of the original set G could have different assigned relative amplitudes.

For this reason, an amplitude corresponding to the sum of the amplitudes of the elements with identical coordinates is assigned to each element of the subsets $\overline{X}$, $\overline{Y}$.

$$E_p^x=\sum_{k=1}^{N}E_k\delta_{\overline{x}_p,x_k}\qquad E_q^y=\sum_{k=1}^{N}E_k\delta_{\overline{y}_q,y_k}\qquad \text{with } \delta_{s,t}=\begin{cases}1 & s=t\\ 0 & s\neq t\end{cases} \tag{21}$$

Figure 7B:
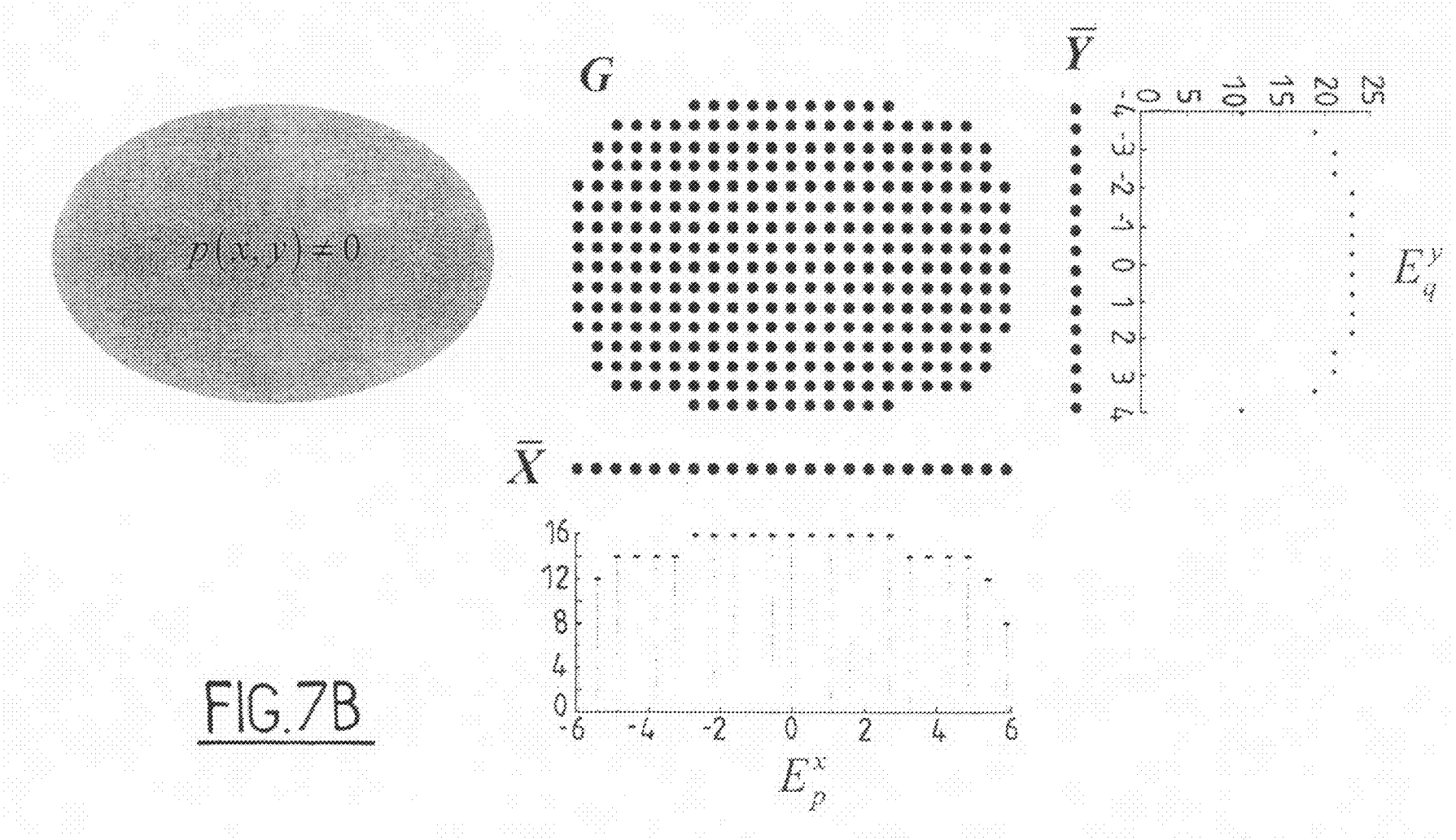

FIG. 7B illustrates a simple example of this preliminary procedure for decomposing a bi-dimensional reference aperture (in this case, a simple elliptical aperture with uniform excitation) in a pair of one-dimensional (periodic) equivalent arrays.

At this point, the one-dimensional synthesis method described above for synthesizing linear aperiodic arrays with prescribed amplitude levels can be applied to these equivalent arrays, leading to two new sets of ordered coordinates corresponding to the positions of the synthesized linear aperiodic array elements along the preferred axes, $$\tilde{X}=\{\tilde{x}_p:p=1,\ldots P\}$$

$$\tilde{Y}=\{\tilde{y}_q:q=1,\ldots Q\} \tag{22}$$

Figure 7C:
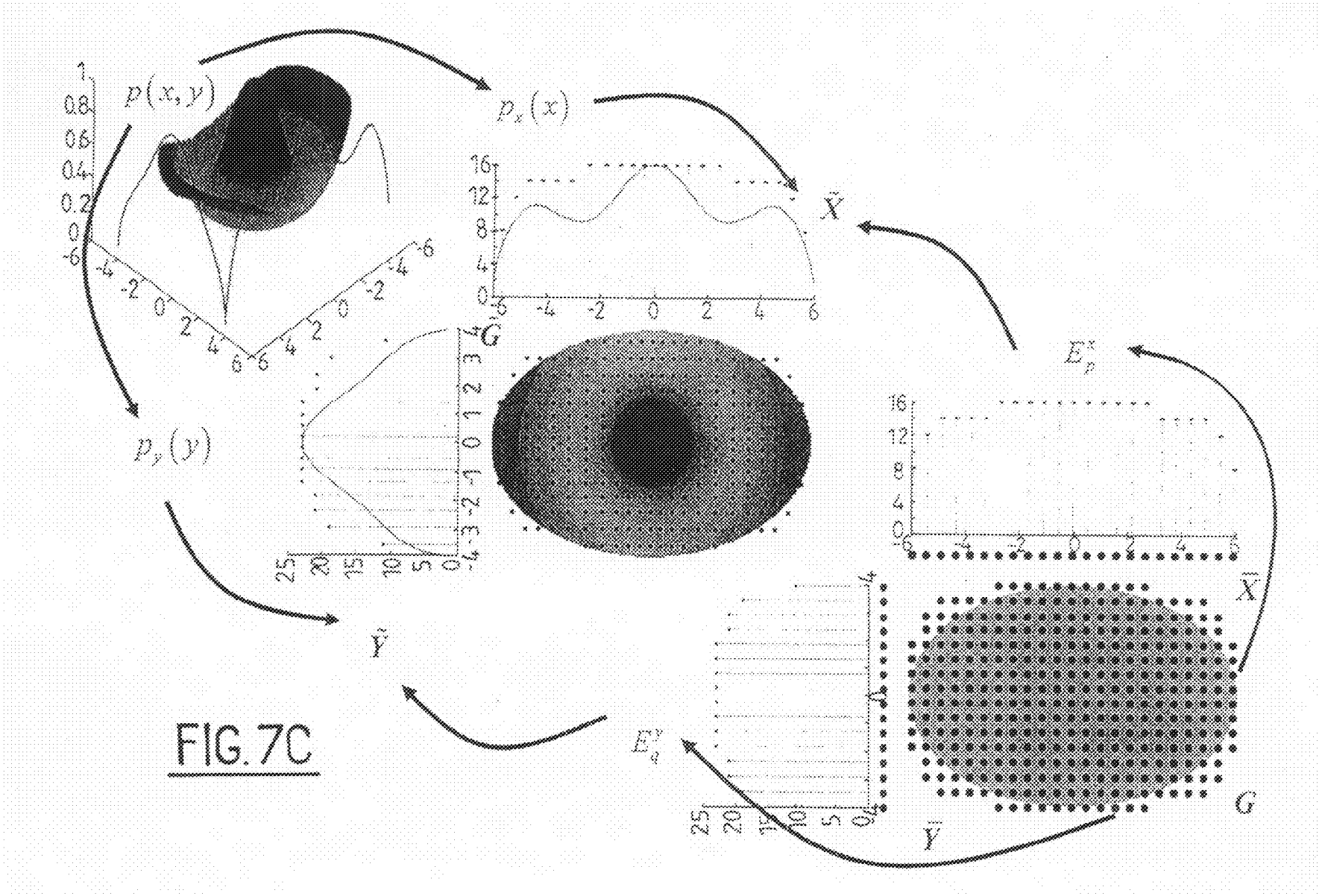

The P positions, $\tilde{x}_p$, of the optimum equivalent aperiodic array in x can be determined using $p_x(x)$ as reference aperture (see FIG. 7C) and $E_p^x$ as pre-assigned amplitude levels.

Equivalently, the Q positions, $\tilde{y}_q$, of the optimum equivalent aperiodic array in y can be determined using $p_y(y)$ as reference aperture (again, see FIG. 7C) and $E_q^y$ as pre-assigned amplitude levels.

Being both $\bar{X}$, $\tilde{X}$ and $\bar{Y}$, $\tilde{Y}$ ordered sets with the same cardinality (respectively P and Q), it is possible to define bijective functions with one-to-one correspondence between the sets, $$t_x:\bar{X}\rightarrow\tilde{X}t_x(\bar{x}_p)=\tilde{x}_p$$

$$t_y:\bar{Y}\rightarrow\tilde{Y}t_y(\bar{y}_q)=\tilde{y}_q \tag{23}$$

The synthesized element positions are finally determined by the set $\tilde{G}$, $$\tilde{G}=\{\tilde{r}_k\equiv\tilde{x}_k+\hat{x}+\tilde{y}_k\hat{y}:k=1,\ldots,N\} \tag{24}$$

where, $$\begin{bmatrix}\tilde{x}_k\\ \tilde{y}_k\end{bmatrix}=\begin{bmatrix}t_x(x_k)\\ t_y(y_k)\end{bmatrix} \tag{25}$$

(central part of FIG. 7C),

In so doing the elements positions are determined such that the radiation pattern of the planar aperiodic array best approximates the reference radiation pattern along two desired principal directions.

The positions are intrinsically optimized in accordance to the optionally assigned amplitude levels $E_k$.

A second method for designing bi-dimensional antenna arrays is more general and does not rely on any hypothesis on the separability of the reference radiation pattern.

As in the previous case, two (typically, but not necessarily, orthogonal) axes are selected in the reference pattern and in the reference aperture.

The planar reference aperture distribution p(x,y) is projected onto the first selected principal axis (e.g. x), $$p_x(x)=\int_{-\infty}^{+\infty}p(x,y)dy \tag{26}$$

A P-element discrete equivalent linear array along x is defined to quantize the $p_x(x)$ distribution. Each "element" of this equivalent array actually represents a linear sub-array in the orthogonal direction y (alternatively, a general direction non parallel to the x axis could have been chosen, but this case will not be discussed in detail).

A normalized distribution $p_x^n(x)$ can be used to determine the number of elements Q(p) of each sub-array. The normalization can be done such that a maximum number of elements per sub-array is defined, $$p_x^n(x)=\frac{Q_{MAX}}{MAX[p_x(x)]}p_x(x) \tag{27}$$

Q(p) can be evaluated rounding $p_x^n(x)$ on a uniform sampling lattice of P elements. As well, other quantization criteria can be implemented depending on the synthesis constraint (e.g. Q(p) even, odd, power of two, etc.).

The overall array will be composed of N elements, where $$N=\sum_{p=1}^{P}Q(p) \tag{28}$$

Optionally, relative amplitude values ($E_{p,q}$) can be assigned to each element q=1, . . . , Q(p) of the p-th sub-array. The amplitude values will constitute the pre-assigned excitations of the equivalent linear array along x.

$$E_p^x=\sum_{q=1}^{Q(p)}E_{p,q} \tag{29}$$

Figure 8A:
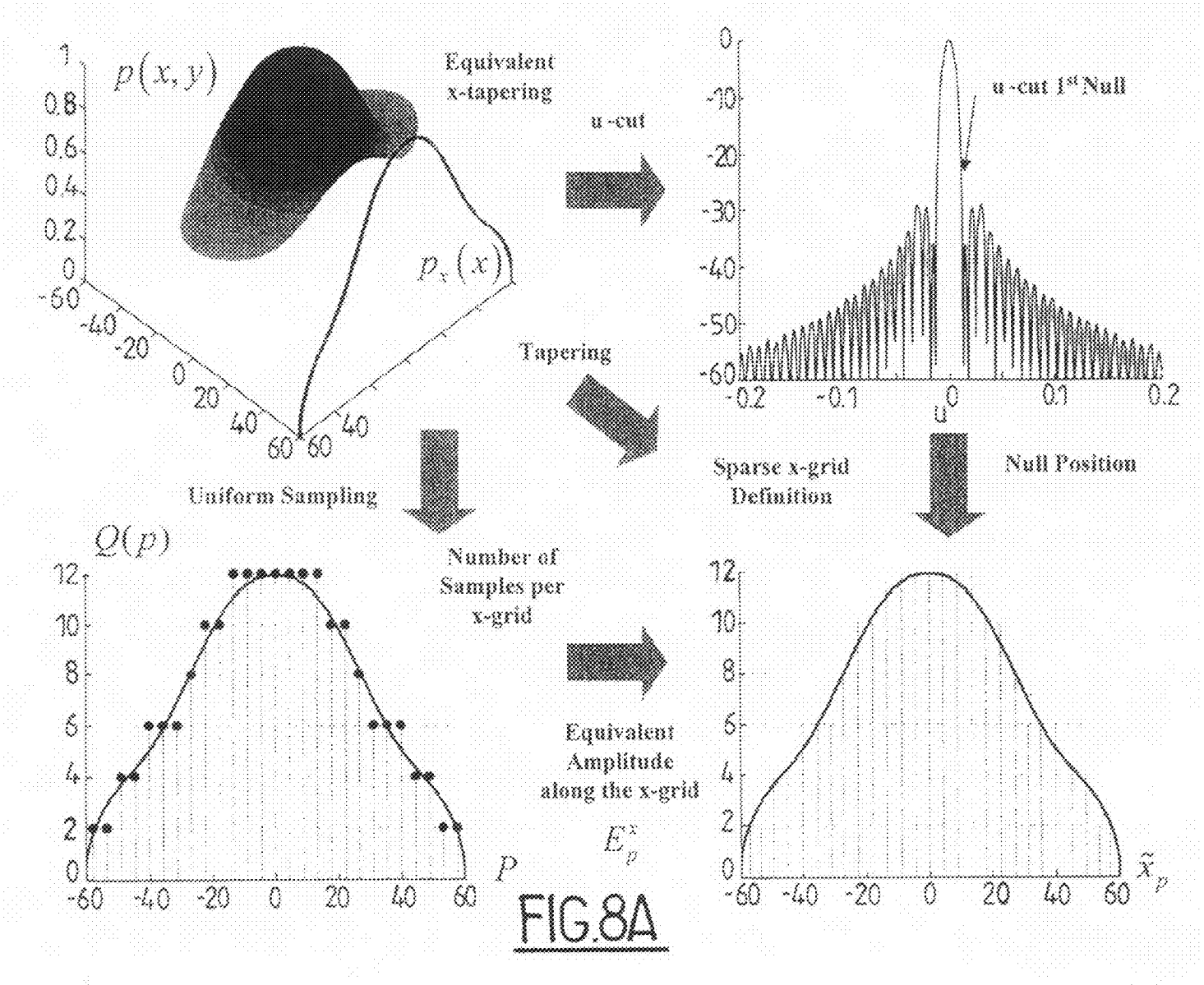
FIGS. 8A and 8B illustrate a further method of the invention, applied to the design of a bi-dimensional array antenna.

The positions $\tilde{x}_p$ of the optimum aperiodic array in x can be determined according to the already described one-dimensional method, with $p_x(x)$ used as reference aperture (see FIG. 8A).

The new set of ordered coordinates $\tilde{X}=\{\tilde{x}_p:p=1,\ldots P\}$ is now used to initialize the synthesis along the orthogonal axis.

A set of equivalent linear reference aperture distributions $p_{y,p}(y)$ is generated sampling the planar reference aperture distribution p(x,y) on lines passing through the points $\tilde{x}_p$ and parallel to the y axis, $$p_{y,p}(y)=p(x,\tilde{y}_p) \tag{30}$$

Different sampling criteria to generate the set of linear equivalent reference distributions along y can be implemented: e.g., slicing p(x,y) in P contiguous linear strips with each $\tilde{x}_p$ internal point of a different strip and evaluating $p_{y,p}(y)$ as slice-projection along y of p(x,y) within the strip.

Figure 8B:
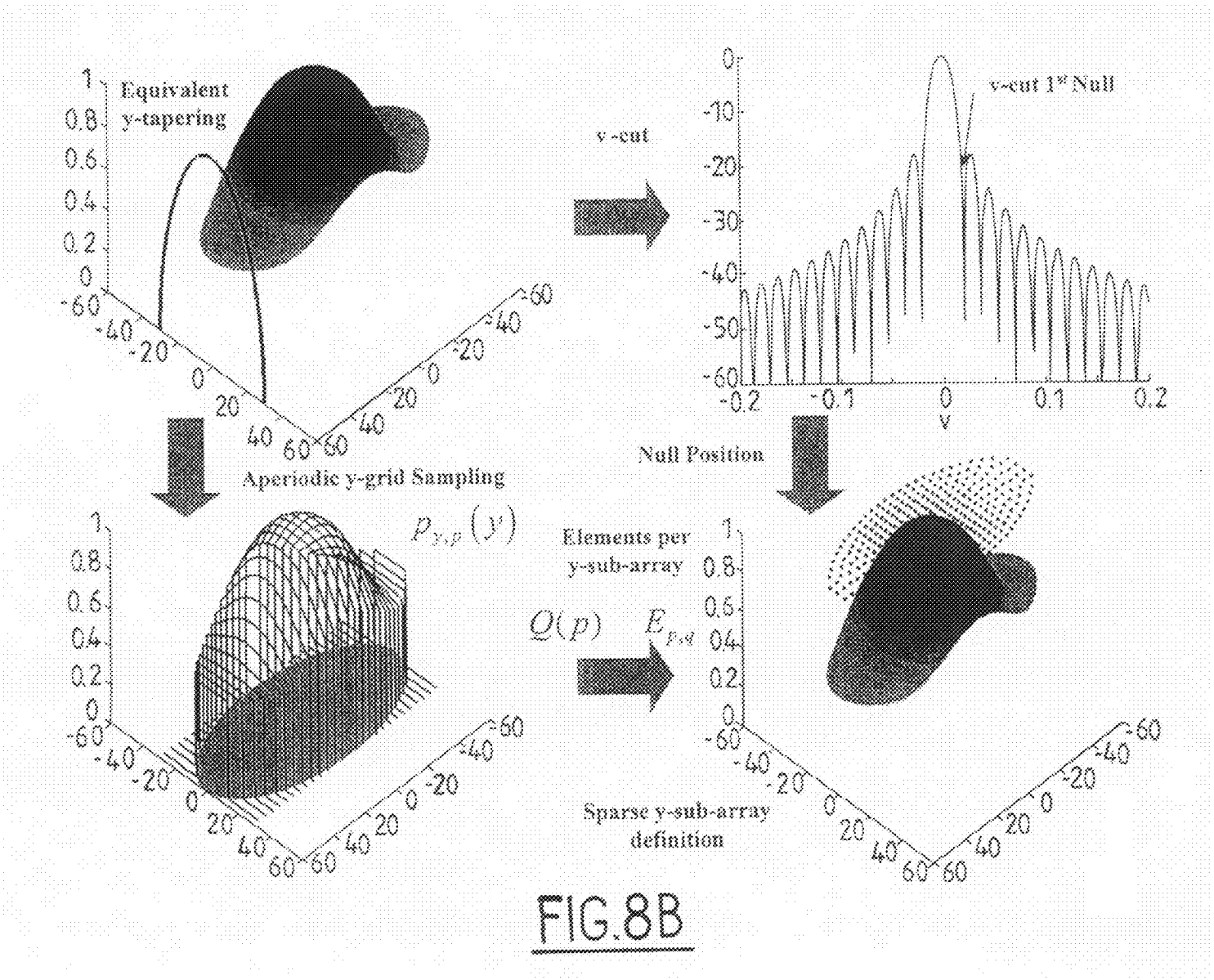

For each $\tilde{x}_p$ a sub-array of Q(p) elements disposed along y must now be synthesized. The positions $\tilde{y}_{p,q}$ of the optimum aperiodic sub-array in y can be determined according to the already described one-dimensional method with $p_{y,p}(y)$ employed as target reference aperture and $E_{p,q}$ as assigned amplitude levels (see FIG. 8B).

The outcome of the synthesis is a set of sub-array positions along x, and Q(p) sets of positions of the elements of the sub-arrays disposed along y, $$\tilde{X}=\{\tilde{x}_p:p=1,\ldots P\}$$

$$\tilde{Y}_p=\{\tilde{y}_{p,q}:q=1,\ldots Q(p)\} \tag{38}$$

The synthesized element positions are finally determined by the set $\tilde{G}$, $$\tilde{G}=\{\tilde{r}_{p,q}\equiv\tilde{x}_p\hat{x}+\tilde{y}_{p,q}\hat{y}:p=1,\ldots,Q;q=1,\ldots,Q(p)\} \tag{32}$$

The positions are intrinsically optimized in accordance to the optionally assigned amplitude levels $E_{p,q}$.

In many cases, a bi-dimensional reference aperture exhibits circular or elliptical symmetry. This allows application of a dedicated synthesis method which will be described here below.

An aperture function with circular symmetry can be expressed as:

$$p(x(\rho,\varphi),\ y(\rho,\varphi)) = p_\rho(\rho)\begin{cases} x(\rho,\varphi) = \rho\cos\varphi \\ y(\rho,\varphi) = \rho\sqrt{1-e^2}\ \sin\varphi \end{cases} \tag{33}$$

The elliptical case can be easily reduced to the circular one by mean of appropriate coordinate transformations.

The far field distribution of a circular aperture characterized by an excitation current $p_\rho(\rho)$ varying only in a radial direction $\rho$ is given by:

$$F(\vartheta_s,\phi)=F(\vartheta_s)=2\pi\int_0^a p_\rho(\rho)\rho J_0(k_0\sin\vartheta_s\rho)d\rho \tag{34}$$

Similarly, a circular ring current source with radius $\rho_k$ and infinitesimal thickness, $$p_\rho(r) = \frac{p_k}{2\pi\rho_k}\delta(\rho-\rho_k) \tag{35}$$

where the circular Dirac's delta is normalized to unitary amplitude, $$\int_0^a\int_0^{2\pi}\frac{1}{2\pi\rho_k}\delta(\rho'-\rho_k)\rho'\,d\rho'\,d\varphi = \frac{1}{2\pi}\int_0^{2\pi}d\varphi = 1 \tag{36}$$

generates a far field:

$$F(\vartheta_s)=p_kJ_0(k_0u\rho_k) \tag{37}$$

u being the observation direction, u=sin(θ).

Considering the parallelism between the continuous and discrete case, the function $\rho p_\rho(\rho)$ represents the equivalent tapering that a circular ring array should have in order to generate a pattern identical to the reference one.

Equation (34) can also be expressed by means of Hankel's special functions [14], $$F(\vartheta_s)=\pi\int_{-a}^{a}\rho p_\rho(\rho)H_0^{(1)}(k_0u\rho)d\rho \tag{38}$$

For fixed θ (and therefore u), equation (38) corresponds to phasorial summation as a function of the radial coordinate ρ, which can be represented as a curve in the complex plane, ρ acting as a drawing parameter. Like in the one-dimensional case, a closed curve corresponds to a null direction $u_0$.

Therefore, the one-dimensional array synthesis method described above can be applied to an equivalent aperture having an excitation function given by $\rho p_\rho(\rho)$.

Figure 9:
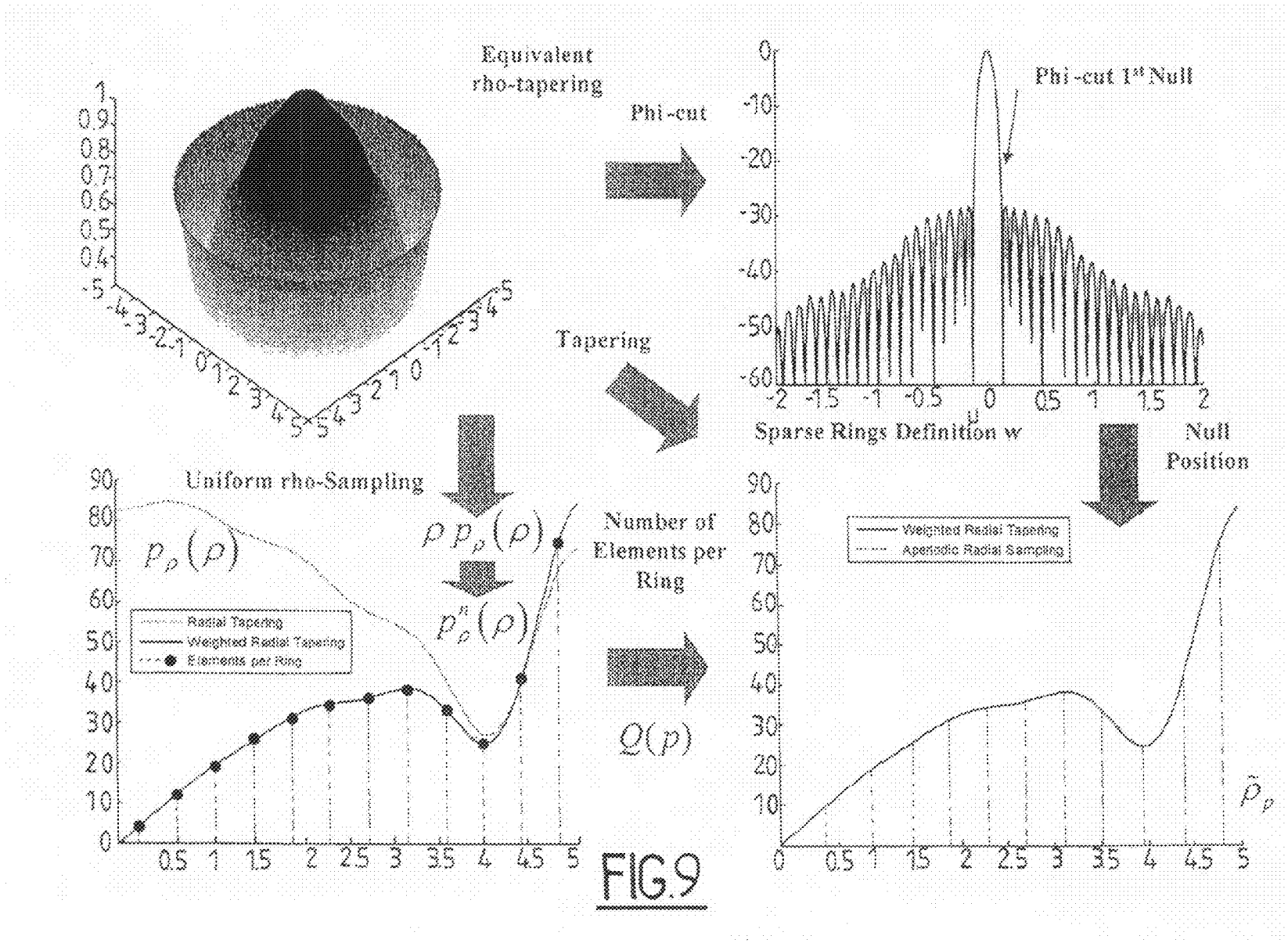
FIG. 9 illustrates still a further method of the invention, applied to the design of a bi-dimensional array antenna.

Concretely, as schematically represented on FIG. 9, the synthesis procedure consists in the following steps:

A discrete ring array with uniform radial spacing is defined to quantize the equivalent radial distribution. The number of rings (P) will depend on the aperture radius and on desired radial sampling.

A normalized distribution $p_\rho^n(\rho)$ can be used to determine the number of elements Q(p) of each ring. The normalization can be done such that a maximum number of elements per ring is defined, $$p_\rho^n(\rho) = \frac{Q_{MAX}}{MAX[\rho p_\rho(\rho)]}\rho p_\rho(\rho) \tag{39}$$

Q(p) can be evaluated rounding $p_\rho^n(\rho)$ on a uniform radial sampling lattice of P elements. As well, other quantization criteria can be implemented depending on the synthesis constraint (e.g. Q(p) even, odd, power of two, etc.).

The overall array will be composed of N elements, where $$N = \sum_{p=1}^{P} Q(p) \tag{40}$$

The positions $\tilde{\rho}_p$ of the optimum aperiodic ring array in ρ can be determined by applying the one-dimensional method of the invention with $\rho p_\rho(\rho)$ employed as objective Reference Aperture. The necessary modifications consist in substituting $H_0^{(1)}(k_0u\rho)$ to $\exp(k_0u\rho)$ in the cumulative curve evaluation and in taking into account the intrinsic amplitude variation of the Hankel's special function.

The final step consists in placing the selected integer number of elements Q(p) on the rings of radius $\tilde{\rho}_p$. The most obvious and most accurate choice is to put them at an equal angular distance. A deterministic or random rotation of the elements from ring to ring can be also employed, although the corresponding results do not change significantly especially for large arrays.

REFERENCES

[1] R. J. Mailloux, *Phased Array Antenna Handbook,* 2nd Edition, Artech House, 2005, pp. 92-106

[2] H. Unz, "Linear arrays with arbitrarily distributed elements," IRE Transactions on Antennas and Propagation, Vol. 8, pp. 222-223, March 1960

[3] R. F. Harrington, "Sidelobe reduction by nonuniform element spacing," IRE Transactions on Antennas and Propagation, Vol. 9, pp. 187-192, March 1961

[4] A. Ishimaru, "Theory of unequally-spaced arrays", IEEE Transactions on Antennas and Propagation, Vol. 10, No. 6, pp. 691-702, November 1962

[5] A. Ishimaru, Y.-S. Chen, "Thinning and broadbanding antenna arrays by unequal spacings", IEEE Transactions on Antennas and Propagation, Vol. 13, No. 1, pp. 3442, January 1965

[6] M. Skolnik, G. Nemhauser, J. Sherman III, "Dynamic programming applied to unequally spaced arrays", IEEE Transactions on Antennas and Propagation, Vol. 12, No. 1, pp. 35-43, January 1964

[7] J. Sherman III, M. Skolnik, "An upper bound for the sidelobes of an unequally spaced array", IEEE Transactions on Antennas and Propagation, Vol. 12, No. 3, pp. 373-374, May 1964

[8] M. Skolnik, J. Sherman III, F. Ogg Jr. "Statistically designed density-tapered arrays", IEEE Transactions on Antennas and Propagation, Vol 12, No. 4, pp. 408-417, July 1964

[9] R. L. Haupt, "Thinned arrays using genetic algorithms", IEEE Transactions on Antennas and Propagation, Vol. 42, pp. 993-999, July 1994.

[10] T. Isernia, F. J. Ares Pena, O. M. Bucci, M. D'Urso, J. Fondevila Gómez, J. A. Rodríguez, "A Hybrid Approach for the Optimal Synthesis of Pencil Beams Through Array Antennas", IEEE Transactions on Antennas and Propagation, Vol. 52, No. 11, pp. 2912-2918, November 2004

[11] J. Robinson, Y. Rahmat-Samii, "Particle Swarm Optimization in Electromagnetics", IEEE Transactions on Antennas and Propagation, Vol. 52, No. 2, pp. 397-407, February 2004

[12] M. C. Viganó, G. Toso, S. Selleri, C. Mangenot, P. Angeletti, G. Pelosi, "GA Optimized Thinned Hexagonal Arrays for Satellite Applications", IEEE International Symposium of the Antennas and Propagation Society (AP-S 2007), Honolulu, Hi. (USA), Jun. 10-15, 2007

[13] G. Toso, M. C. Viganó, P. Angeletti, "Null-Matching for the design of linear aperiodic arrays", IEEE International Symposium on Antennas and Propagation 2007, Honolulu Hi. USA, Jun. 10-15 2007.

[14] M. Abramowitz, I. A. Stegun, (Editors), *Handbook of Mathematical Functions with Formulas, Graphs, and Mathematical Tables*, National Institute of Standards and Technology, 5th Printing, 1966

The invention claimed is:

1. A method of manufacturing an array antenna comprising:

a step of designing an antenna array pattern of an array antenna; and a step of physically manufacturing said array antenna using said designing step;

wherein said step of designing said array pattern comprises:

(a) determining a continuous or discrete one-dimensional reference aperture, associated to a one-dimensional reference radiation pattern;

(b) choosing a reference radiation direction for said reference radiation pattern;

(c) computing a cumulative phasorial summation of a field distribution of said reference aperture in said reference direction and representing said summation as a reference curve in a complex plane;

(d) determining a polygonal curve constituting a polygonal approximation of said reference curve, subject to predetermined constraints;

(e) determining, from said polygonal curve, an array pattern wherein:

each side of said polygonal curve is associated to a particular antenna element of the array;

the length of each side represents a normalized amplitude of an excitation field associated with the corresponding antenna element; and the angles formed by each pair of adjacent sides correspond to a parameter chosen among:

a distance between the elements of the array associated to said sides;

a difference between the phases of the excitation fields associated with said elements of the array; and a combination of both.

2. The method of claim 1 wherein said reference curve and said polygonal curve both have a first and a second endpoint, and wherein the endpoints of said polygonal curve are constrained to coincide with that of said reference curve.

3. The method of claim 1, wherein said reference direction is determined such as to correspond to a null of said reference radiation pattern.

4. The method of claim 3, wherein said reference direction is determined such as to correspond to the first null of said reference radiation pattern.

5. The method of claim 1, wherein said polygonal curve constitutes a polygonal approximation of said reference curve which is optimal according to a weighted least-mean-squares criterion.

6. The method of claim 1, wherein said reference curve is symmetric, and its symmetry is taken into account while determining said polygonal approximation thereof.

7. The method of claim 1, wherein the sides of said polygonal curve are constrained to have a normalized length which is chosen between a discrete set of predetermined allowed values.

8. The method of claim 7, wherein said discrete set comprises a number of allowed length values which is smaller by at least a factor of 10 than the number of sides of said array.

9. The method of claim 7, wherein said predetermined allowed values are in a commensurable relationship with each others.

10. The method of claim 1, wherein said polygonal curve is constrained to be equilateral.

11. The method of claim 1, wherein the angles formed by each pair of adjacent sides are constrained to be integer multiples of a predetermined minimum angle.

12. The method of claim 1, wherein the sides of said polygonal curve are constrained to be chords of said reference curve.

13. The method of claim 1, wherein the angles formed by each pair of adjacent sides of said polygonal curve correspond to a distance between the elements of the array associated to said sides, the excitation field of said elements having an uniform phase.

14. The method of claim 1, wherein the angles between adjacent sides alternatively take positive and negative modulo-180° values.

15. The method of claim 14, wherein the angles formed by each pair of adjacent sides of said polygonal curve correspond to a difference between the phases of the excitation fields associated with said elements of the array, the distance between the elements of said arrays being constant.

16. The method of claim 1, wherein the array antenna to be manufactured is a one-dimensional antenna.

17. The method of claim 16, wherein said reference aperture is the aperture of an antenna whose radiation pattern corresponds to said reference radiation pattern.

18. The method of claim 17, wherein the antenna array pattern determined by operation (e) of the design step is used as the array pattern of the antenna to be manufactured, directly or after an additional adjustment operation, whereby the radiation pattern of said antenna to be manufactured approximates said reference radiation pattern.

19. The method of claim 16, wherein said reference aperture is represented by a real, non-negative function obtained by taking the absolute value of a real function showing changes of sign and representing an original reference aperture corresponding to said reference radiation pattern; and wherein said design step further comprises imposing a phase shift of 180° to the excitation field of antenna elements corresponding portions of said original reference aperture having a negative sign.

20. The method of claim 1, wherein said array antenna is a bi-dimensional array antenna and wherein said step of designing the array pattern thereof comprises:

(α) choosing a bi-dimensional reference radiation pattern, corresponding to a continuous or discrete bi-dimensional reference aperture;

(a') decomposing said bi-dimensional reference radiation pattern in a set of equivalent one-dimensional reference radiation patterns, and (b-e) applying sub-steps (b) to (e) to said equivalent one-dimensional reference radiation patterns in order to determine a set of equivalent one-dimensional array antenna patterns approximating said equivalent one-dimensional reference radiation pattern; and (β) constructing the array pattern of said bi-dimensional array antenna from said set of equivalent one-dimensional array antenna patterns.

21. The method of claim 20, comprising:

(A) selecting a pair of preferred non-parallel axes for said bi-dimensional reference aperture;

(B) projecting said bi-dimensional reference aperture on said preferred axes, in order to obtain a first and a second equivalent one-dimensional reference aperture, each having an associated equivalent one-dimensional reference radiation pattern;

(C) applying sub-steps (b) to (e) to said first and second equivalent one-dimensional reference radiation patterns, in order to determine first and second equivalent one-dimensional array antenna patterns; and (D) constructing an array pattern of the bi-dimensional array antenna to be manufactured comprising rows and columns of antenna elements, said rows and columns being aligned along said preferred axes.

22. The method of claim 21, further comprising:

(A') determining a parallelogram grid, whose elements are aligned on said preferred axes, said grid having a number of elements equivalent to that of the bi-dimensional array antenna to be designed;

wherein said step (C) comprises determining first and second equivalent one-dimensional array antenna patterns, each consisting of a number of elements equal to that of said parallelogram grid along the corresponding preferred axis;

and wherein said step (D) comprises constructing a bi-dimensional array pattern in which:

the bi-dimensional coordinates of each antenna element are given by the one-dimensional coordinates of equivalent elements of said first and second equivalent one-dimensional array antenna patterns; and the normalized amplitudes of the excitation fields of each antenna element are given by the sum of the normalized amplitudes of the elements of said first and second equivalent one-dimensional array antenna patterns having the same coordinates.

23. The method of claim 20, comprising:

(A) selecting a first preferred parallel axis for said bi-dimensional reference aperture, and a second preferred axis non parallel to said first preferred axis;

(B) projecting said bi-dimensional reference aperture on said first preferred axis, in order to obtain a first equivalent one-dimensional reference aperture , (C) applying sub-steps (b) to (e) to said first equivalent one-dimensional reference radiation pattern, in order to obtain a first equivalent one-dimensional array antenna pattern, each equivalent antenna element of said first equivalent one-dimensional array antenna pattern corresponding to a respective one-dimensional sub-array aligned along a direction perpendicular to said preferred axis;

(D) determining a set of second equivalent one-dimensional reference apertures, by taking the values of said bi-dimensional reference aperture along lines parallel to said second preferred axis, each of said lines passing through a respective equivalent antenna element of said first reference aperture; and (E) applying sub-steps (b) to (e) to each of said second equivalent one-dimensional reference apertures in order to obtain corresponding array patterns of said one-dimensional sub-arrays;

whereby the array pattern of the bi-dimensional array antenna to be manufactured comprises rows of antenna elements, said rows being aligned along said first preferred axis.

24. The method of claim 23 further comprising, after said step (C), a step of quantizing the amplitudes of the excitation fields of the equivalent antenna elements of said first equivalent one-dimensional array antenna pattern; and wherein step (E) is performed by taking, for each of said one-dimensional sub-arrays, a number of antenna elements proportional to the quantized amplitude of the corresponding equivalent antenna element.

25. The method of claim 20, wherein said bi-dimensional reference aperture exhibits cylindrical central symmetry, the method comprising:

determining a single equivalent one-dimensional reference aperture by taking the values said bi-dimensional reference aperture along a radial direction multiplied by the value of a radial coordinate along said radial direction; and constructing an array pattern of the bi-dimensional array antenna to be manufactured comprising concentric circular rings.

26. The method of claim 25, comprising the steps of:

(A*) designing a discrete array of concentric circular rings with uniform radial spacing for spatially quantizing said bi-dimensional reference aperture, the number of rings of said array depending on that of the bi-dimensional array antenna to be manufactured;

(B*) determining an equivalent one-dimensional reference aperture by taking the values of said spatially quantized said bi-dimensional reference aperture along a radial direction of said concentric rings, multiplied by the value of a radial coordinate along said radial direction;

(C*) applying sub-steps (b) to (e) to said equivalent one-dimensional reference radiation pattern, in order to obtain an equivalent one-dimensional array antenna pattern;

whereby the array pattern of the bi-dimensional array antenna to be manufactured comprises concentric circular rings.

27. A method of manufacturing a bi-dimensional array antenna comprising:

a step of designing an antenna array pattern of said array antenna; and a step of physically manufacturing said array antenna;

wherein said step of designing said array pattern comprises applying a coordinate change for converting said bi-dimensional reference aperture into a bi-dimensional reference aperture exhibiting cylindrical central symmetry;

applying the design method of claim 25 to said converted bi-dimensional reference aperture; and applying an inverse coordinate change adapted for obtaining a bi-dimensional array antenna comprising concentric elliptical rings.

28. A method according to claims 25, further comprising, after said step (A*), a step of quantizing the amplitudes of the excitation fields of the equivalent antenna elements of said equivalent one-dimensional array antenna pattern; and wherein each ring of the array pattern of the bi-dimensional array antenna to be manufactured comprises a number of antenna elements proportional to the corresponding quantized excitation field.

29. The method of claim 1, wherein said step of designing the array pattern of said array antenna also comprises further modifying the thus determined array pattern in order to comply with technological constraints.

30. A computer readable non-transitory medium adapted for carrying out the design step of the method according to claim 1.

* * * * *